US008500615B2

(12) United States Patent
Imamura et al.

(10) Patent No.: US 8,500,615 B2
(45) Date of Patent: Aug. 6, 2013

(54) MAGNETIC ROLLER AND MANUFACTURING METHOD THEREOF, DEVELOPER CARRIER, DEVELOPMENT DEVICE, PROCESSING CARTRIDGE, AND IMAGE FORMING APPARATUS

(75) Inventors: Tsuyoshi Imamura, Sagamihara (JP); Yoshiyuki Takano, Hachioji (JP); Kyohta Koetsuka, Fujisawa (JP); Tadaaki Hattori, Hadano (JP); Noriyuki Kamiya, Yamato (JP); Hiroya Abe, Yokohama (JP); Mieko Terashima, Isehara (JP); Masayuki Ohsawa, Atsugi (JP); Takashi Innami, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 1221 days.

(21) Appl. No.: 11/968,939

(22) Filed: Jan. 3, 2008

(65) Prior Publication Data

US 2008/0298849 A1 Dec. 4, 2008

(30) Foreign Application Priority Data

Jan. 11, 2007 (JP) ..... 2007-003424
Feb. 14, 2007 (JP) ..... 2007-033410

(51) Int. Cl.
*G03G 19/00* (2006.01)
*G03G 15/09* (2006.01)

(52) U.S. Cl.
USPC ..... 492/8; 492/18; 399/277

(58) Field of Classification Search
USPC ..... 492/8, 18, 30, 37; 399/277
See application file for complete search history.

(56) References Cited

U.S. PATENT DOCUMENTS 3,945,342 A * 3/1976 Drummond, Jr. ..... 399/276
4,425,382 A * 1/1984 Tajima ..... 427/203
4,517,719 A * 5/1985 Okumura et al. ..... 492/8
4,557,582 A * 12/1985 Kan et al. ..... 399/276
4,587,699 A * 5/1986 Kadomatsu et al. ..... 492/8
4,608,737 A * 9/1986 Parks et al. ..... 492/8
4,640,808 A * 2/1987 Okumura et al. ..... 264/46.5
4,823,102 A * 4/1989 Cherian et al. ..... 335/306
4,954,800 A 9/1990 Ohtsuka (Continued)

FOREIGN PATENT DOCUMENTS

JP 58-173807 10/1983
JP 60-59377 4/1985

(Continued)

OTHER PUBLICATIONS

U.S. Appl. No. 12/040,450, filed Feb. 29, 2008, Takano, et al.

(Continued)

*Primary Examiner* — Essama Omgba
(74) *Attorney, Agent, or Firm* — Oblon, Spivak, McClelland, Maier & Neustadt, L.L.P.

(57) ABSTRACT

A magnetic roller includes a solid-core roller having magnetic anisotropy in a direction orthogonal to a central axis thereof. The solid-core roller includes a body part, and shaft parts disposed on both ends of the body part, a concave groove provided in an outer circumference face of the body part to extend in an axial direction, and a magnetic block disposed in the concave groove, the magnetic block having a direction of magnetic anisotropy substantially orthogonal to a direction of the magnetic anisotropy of the magnetic roller.

14 Claims, 16 Drawing Sheets

U.S. PATENT DOCUMENTS

| | | | | |
|---|---|---|---|---|
| 5,030,937 | A * | 7/1991 | Loubier et al. | 335/303 |
| 5,181,971 | A | 1/1993 | Ohtsuka | |
| 5,384,957 | A * | 1/1995 | Mohri et al. | 29/895.32 |
| 5,529,628 | A * | 6/1996 | Fuchiwaki et al. | 399/275 |
| 5,768,667 | A * | 6/1998 | Bessette | 399/275 |
| 5,860,049 | A * | 1/1999 | Kumasaka et al. | 399/267 |
| 5,938,579 | A * | 8/1999 | Cavazos | 492/8 |
| 6,021,296 | A * | 2/2000 | Tamura et al. | 399/277 |
| 6,061,541 | A * | 5/2000 | Bessette | 399/277 |
| 6,070,038 | A * | 5/2000 | Imamura et al. | 399/277 |
| 6,102,841 | A * | 8/2000 | Genovese | 492/8 |
| 6,125,255 | A * | 9/2000 | Litman et al. | 399/277 |
| 6,343,419 | B1 * | 2/2002 | Litman et al. | 29/895.32 |
| 6,397,747 | B1 * | 6/2002 | McEachern | 101/389.1 |
| 6,421,519 | B1 * | 7/2002 | Yamashita et al. | 399/277 |
| 6,422,984 | B1 * | 7/2002 | Masham et al. | 492/8 |
| 6,454,686 | B1 * | 9/2002 | McEachern | 492/8 |
| 6,496,675 | B1 * | 12/2002 | Sugiyama et al. | 399/277 |
| 6,654,582 | B2 * | 11/2003 | Jones et al. | 399/277 |
| 6,671,484 | B2 * | 12/2003 | Miyoshi et al. | 399/277 |
| 6,697,593 | B2 * | 2/2004 | Imamura et al. | 399/267 |
| 6,762,665 | B1 * | 7/2004 | Iwai et al. | 335/306 |
| 6,850,140 | B1 * | 2/2005 | Gleckner | 335/306 |
| 7,121,199 | B2 * | 10/2006 | Perault et al. | 101/126 |
| 7,156,797 | B2 * | 1/2007 | Komatsu et al. | 492/47 |
| 7,194,231 | B2 * | 3/2007 | Wu et al. | 399/277 |
| 7,203,450 | B2 * | 4/2007 | Kakegawa et al. | 399/277 |
| 7,890,030 | B2 * | 2/2011 | Innami et al. | 399/277 |
| 7,891,094 | B2 * | 2/2011 | Imamura et al. | 29/895.3 |
| 7,917,067 | B2 * | 3/2011 | Takano et al. | 399/267 |
| 8,023,867 | B2 * | 9/2011 | Takano et al. | 399/267 |
| 8,135,314 | B2 * | 3/2012 | Miyoshi et al. | 399/267 |
| 2002/0128137 | A1 * | 9/2002 | Masham et al. | 492/8 |
| 2004/0018031 | A1 | 1/2004 | Imamura et al. | |
| 2005/0135843 | A1 * | 6/2005 | Kakegawa et al. | 399/276 |
| 2007/0127352 | A1 * | 6/2007 | Oshima et al. | 369/275.1 |
| 2008/0170891 | A1 * | 7/2008 | Abe et al. | 399/277 |
| 2008/0213007 | A1 * | 9/2008 | Takano et al. | 399/277 |
| 2008/0232865 | A1 * | 9/2008 | Terashima et al. | 399/286 |
| 2009/0175666 | A1 * | 7/2009 | Takano et al. | 399/356 |

FOREIGN PATENT DOCUMENTS

| | | | |
|---|---|---|---|
| JP | 61-112310 | | 5/1986 |
| JP | 63-182803 | | 7/1988 |
| JP | 63182803 | A * | 7/1988 |
| JP | 5-33802 | | 5/1993 |
| JP | 05291028 | A * | 11/1993 |
| JP | 8-234561 | | 9/1996 |
| JP | 9-180933 | | 7/1997 |
| JP | 2000-68120 | | 3/2000 |
| JP | 2000-81789 | | 3/2000 |
| JP | 2000231256 | A * | 8/2000 |
| JP | 2000-243620 | | 9/2000 |
| JP | 2000-269024 | | 9/2000 |
| JP | 2001-138207 | | 5/2001 |
| JP | 2002-13641 | | 1/2002 |
| JP | 2002-231526 | | 8/2002 |
| JP | 2004-46090 | | 2/2004 |
| JP | 2004-78040 | | 3/2004 |
| JP | 2004-94235 | | 3/2004 |
| JP | 2005-300935 | | 10/2005 |
| JP | 2005-303115 | | 10/2005 |
| JP | 3989180 | | 7/2007 |
| JP | 2008197444 | A * | 8/2008 |
| WO | WO 2005/119374 | A1 | 12/2005 |

OTHER PUBLICATIONS

Office Action issued Aug. 23, 2011 in Japan Application No. 2007-033410.

Office Action issued Aug. 23, 2011 in Japan Application No. 2007-003424.

Japanese Office Action issued Dec. 20, 2011 in patent application No. 2007-003424.

Office Action issued Oct. 10, 2012, in Chinese Patent Application No. 200810003163.X with English translation.

* cited by examiner

MAGNETIC ROLLER AND MANUFACTURING METHOD THEREOF, DEVELOPER CARRIER, DEVELOPMENT DEVICE, PROCESSING CARTRIDGE, AND IMAGE FORMING APPARATUS

PRIORITY CLAIM

The present application is based on and claims priorities from Japanese Patent Application No. 2007-003424, filed on Jan. 11, 2007, and Japanese Patent Application No. 2007-033410, filed on Feb. 14, 2007, the disclosures of which are hereby incorporated by reference in their entirety.

BACKGROUND OF THE INVENTION

1. Field of the Invention

The present invention relates to a magnetic roller, a development device, and a processing cartridge for use in an image forming apparatus such as a copying machine, a facsimile, and a printer, and to an image forming apparatus. More particularly, the present invention relates to a development device for developing an electrostatic latent image on a photoreceptor drum, so as to form a toner image by feeding developer carried by a development sleeve including a non-magnetic cylindrical body onto a development area where the photoreceptor drum faces the development sleeve at intervals, and a magnetic roller for use in the development device. Moreover, the present invention relates to an image forming apparatus including the development device and a processing cartridge.

2. Description of Related Art

Conventionally, in an image forming apparatus having a photoreceptor drum as an image carrier, such as a copying machine, a printer, and a facsimile based on an electrongraphic method, for example, an image is transferred by the following operations. At first, a photosensitive layer of the photoreceptor drum is charged by a charging roller. Next, an electrostatic latent image is formed by exposing the photoreceptor drum to a laser beam from a laser scanning unit, and the electrostatic latent image is developed by toner, and then an image is transferred onto transfer paper as a transfer material.

A development device having a so-called two-component development process using developer mixed non-magnetic toner with magnetic carriers is used in the above-described image forming apparatus. The development device having the two-component development process includes a developer carrier having a columnar development sleeve and a magnetic roller disposed in the development sleeve.

The magnetic roller includes a body part having a circumferential face buried with a magnet. A plurality of magnetic poles is formed by the magnet. In this case, the magnet for forming each of the magnetic poles is formed in the shape of a bar, for example. Especially, a development main magnetic pole for napping the developer in the shape of a brush is formed in a part corresponding to the development area part of the surface of the development sleeve. The developer napped in the shape of a brush by the magnetic pole moves in the circumferential direction by rotating at least either the development sleeve or the magnetic roller. In order to easily feed the developer, a surface roughening process such as a grooving process and a sandblast process is generally conducted on the surface of the development sleeve. The surface roughening process such as the grooving process and the sandblast process is conducted for preventing a decrease in the image concentration caused by the developer slipping and remaining on the surface of the development sleeve rotating at a high speed.

FIG. 20 illustrates a development device of related art. A development device 3' includes a developer carrier 4' for feeding developer to a development area facing a photoreceptor drum 23', and developing an electrostatic latent image formed on the surface of the photoreceptor drum 23', so as to form a toner image. In addition, the developer carrier 4' includes a cylindrically formed development sleeve 5' and a magnetic roller 6' housed in the development sleeve 5' for forming magnetic fields, so as to nap the developer onto the surface of the development sleeve 5'. In the developer carrier 4', when napping the developer, the magnetic carriers constituting the developer are napped onto the development sleeve 5' along the magnetic lines generated by the magnetic roller 6'. The toner constituting the developer is adhered onto the napped magnetic carriers.

Such a development device 3' includes a developer tank 311' for containing the above-described developer, a screw-shaped agitation member 312' for agitating the developer in the developer tank 311', and a developer control member 32' for equalizing the amount of developer transferred onto the developer carrier 4'.

In the development device 3' illustrated in FIG. 20, the developer tank 311' includes a pair of developer tanks 311*a*', 311*b*' and the agitation member 312' includes a pair of agitation members 312*a*', 312*b*'. The developer in the development device 3' moves in the developer tank 311' in the axial direction of the agitation member 312'. The toner supplied from one end portion of one developer tank 311*a*' on the side furthermost away from the developer carrier 4' is agitated with the developer by one agitation member 312*a*' while being fed to the other end portion of the one developer tank 311*a*' along the axial direction of the one agitation member 312*a*'. The developer moves into the other developer tank 311*b*' close to the developer carrier 4' from the other end portion of one developer tank 311*a*'. The developer moved into the other developer tank 311*b*' close to the developer carrier 4' is transferred onto the surface of the development sleeve 5' by the magnetic force of the magnetic roller 6'. After that, the amount of developer is uniformed by the developer control member 32', and then is fed to a development area 41' where the photoreceptor drum 23' faces the developer carrier 4' at intervals. Then, the developer develops the electrostatic latent image formed on the photoreceptor drum 23', so as to form a toner image.

Recently, such an image forming apparatus has been increasingly colorized and downsized. Since four development devices are generally built in a color copying machine, it is necessary to downsize each of the built-in development devices for downsizing the copying machine, and also it is necessary to downsize each of the developer carriers provided in each of the development devices for downsizing each of the development devices. In this case, if the developer carrier is downsized, the following problems occur.

1) A high magnetic force (generally, 100 mT or more on the developer carrier) is required for the development main magnetic pole and the adjacent magnetic poles of the magnetic roller, in order to prevent the adhesion of the developer onto the photoreceptor drum, but the volume of the magnetic roller decreases in the downsized developer carrier. Therefore, it is difficult to obtain a high magnetic force.

2) In the case of a developer carrier having a reduced diameter, if the sandblast process conventionally used as the surface treatment method of the development sleeve is conducted, the development sleeve often deforms because the rigidity of the development sleeve is low. Therefore, it is difficult to obtain a shape of the developer carrier with high accuracy.

3) In the case of a developer carrier having a reduced diameter, the magnetic force change by the distance from the surface of the developer carrier increases. Therefore, it is difficult to stably attach the developer onto the developer carrier.

With respect to the above problems, a method of artificially conducting multi-pole orientation so as to enable magnetic pole formation of a multi-pole arrangement with an integral structure is proposed as described in JP H05-033802B, for example. However, with this method, there is a problem in that only about 90 mT of the magnetic force of the main magnetic pole is obtained on the developer carrier. There is also a problem in that the die structure becomes complex because the artificial multi-pole structure is adopted.

Moreover, a structure in which a magnetic block is attached to a part of a magnetic roller including an isotopic ferrite plastic magnet is proposed as described in JP2000-068120A. However, with this structure, it is difficult to achieve the magnetic flux density required for a magnetic pole except for the development main magnetic pole. For this reason, there is a problem in that this structure is not suitable for a two-component development device, and it is difficult for the above-described structure to be used for a color electrophotographic apparatus.

Furthermore, according to the invention described in JP3989180B, the present inventors propose a method of molding a plastic magnet into a pipe shape by means of extrusion molding, inserting a cored bar into a hollow part, and burying a rare-earth magnet in the circumferential face. In this case, if the outer diameter of the magnetic roller is reduced for downsizing, a sufficient volume of the magnet can not be obtained. Therefore, there is a problem in that it is difficult to obtain a high magnetic force.

SUMMARY OF THE INVENTION

The present invention has been made in view of the above problems. The present invention provides a magnetic roller, which generates a high magnetic force even if it has a reduced diameter and has a long operating life, and a developer carrier having the magnetic roller. In addition, the present invention provides a development device, which has a reduced size and can obtain a high quality image, a processing cartridge and an image forming apparatus.

A first aspect of the present invention relates to a magnetic roller including a solid-core roller having magnetic anisotropy in a direction orthogonal to a central axis thereof, the solid-core roller including a body part, and shaft parts disposed on both ends of the body part, a concave groove provided in an outer circumference face of the body part to extend in an axial direction, and a magnetic block disposed in the concave groove, the magnetic block having a direction of magnetic anisotropy substantially orthogonal to a direction of the magnetic anisotropy of the magnetic roller.

According to one embodiment of the present invention, the shaft parts are not magnetized.

According to one embodiment of the present invention, the magnetic flux density of the magnetic roller on a reverse-rotation direction side of the magnetic roller adjacent to the magnetic block is equal to the magnetic flux density near the magnetic block.

According to one embodiment of the present invention, the magnetic block is a rare-earth magnet.

A second aspect of the present invention relates to a developer carrier including a cylindrical development sleeve, and a magnetic roller having a body part and shaft parts provided on both ends of the body part, the magnetic roller being coaxially disposed inside the development sleeve, the magnetic roller including a solid-core roller having magnetic anisotropy in a direction orthogonal to a central axis thereof, a concave groove disposed in an outer circumference face of the magnetic roller to extend in an axial direction, and a magnetic block disposed in the concave groove, the magnetic block having a direction of magnetic anisotropy substantially orthogonal to a direction of magnetic anisotropy of the magnetic roller.

According to one embodiment of the present invention, the shaft parts are not magnetized.

According to one embodiment of the present invention, the magnetic flux density of the magnetic roller on a reverse-rotation direction side of the magnetic roller adjacent to the magnetic block is equal to magnetic flux density near the magnetic block.

According to one embodiment of the present invention, the development sleeve has a large number of concave portions formed by randomly crushing linear materials disposed in a rotation magnetic field onto an outer circumference face of the development sleeve by using the rotation magnetic field.

A third aspect of the present invention relates to a method of manufacturing a magnetic roller including a magnetic field applying and molding process of inserting a mixed material including magnetic powder and a high polymer compound into an injection molding die, and simultaneously molding a body part and shaft parts of the magnetic roller by means of injection molding, while applying a magnetic filed in one direction of the injection molding die, a demagnetization process of demagnetizing the magnetic roller obtained by the magnetic field application and molding process, and a re-magnetization process of re-magnetizing the magnetic roller after the demagnetization process by the demagnetization process to have a desired magnetic property.

According to one embodiment of the present invention, the magnetization in the re-magnetization process is only conducted on the body part.

According to one embodiment of the present invention, the method of manufacturing a magnetic roller further includes a shaft part demagnetization process of demagnetizing the shaft parts after the re-magnetization process.

A development device according to one embodiment of the present invention includes the above-described developer carrier.

According to one embodiment of the present invention, the developer includes toner and magnetic carriers, and an average particle diameter of each of the magnetic carriers is 20 μm or more and 50 μm or less.

A processing cartridge according to one embodiment of the present invention includes the above-described development device.

An image forming apparatus according to one embodiment of the present invention includes the above-described processing cartridge.

BRIEF DESCRIPTION OF THE DRAWINGS

These and other features, aspects, and advantages of the present invention will become better understood with regard to the following description, appended claims, and accompanying drawings.

DETAILED DESCRIPTION OF THE PREFERRED EMBODIMENTS

Hereinbelow, embodiments of the present invention will be described with reference to the accompanying drawings.

First Embodiment

Figure 1A:
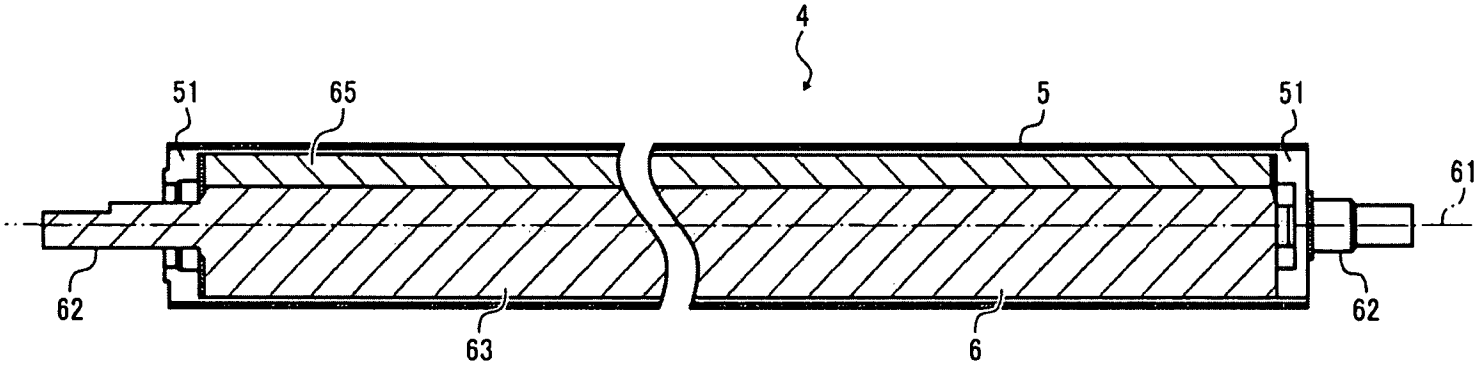
FIG. 1A is a sectional view in the axial direction illustrating a developer carrier according to a first embodiment of the present invention.
Figure 1B:
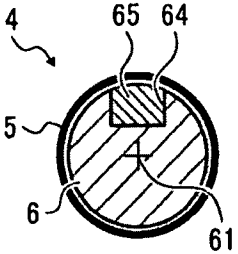
FIG. 1B is a sectional view in the direction perpendicular to the axial direction.
Figure 2:
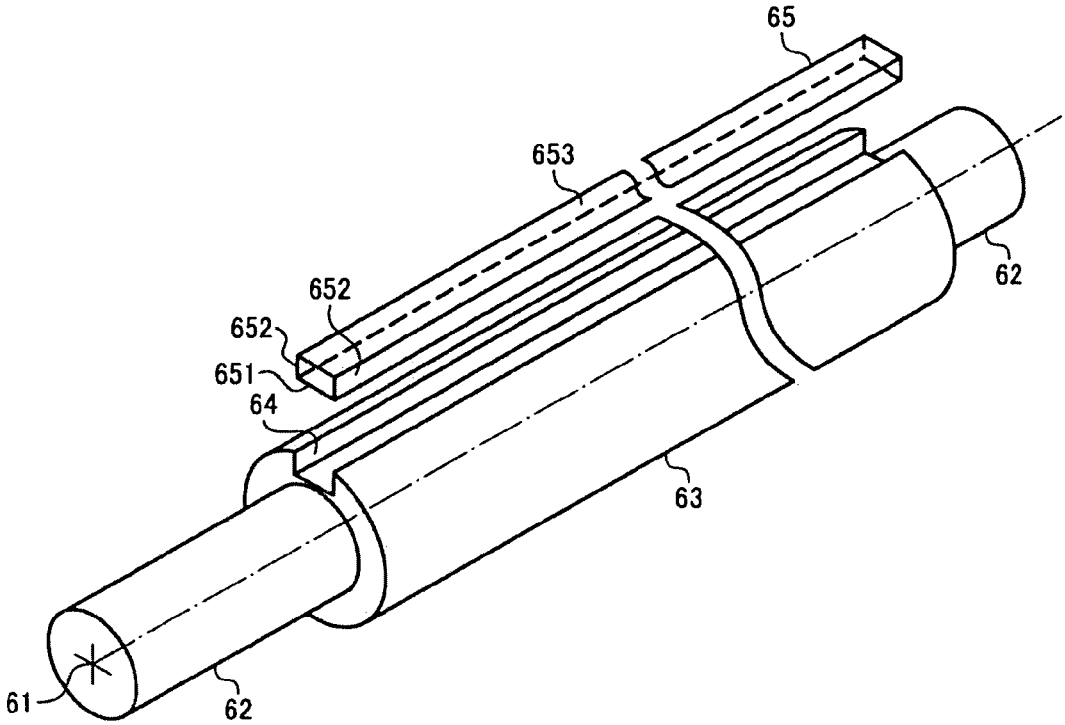
FIG. 2 is a perspective view illustrating a magnetic-roller according to the first embodiment of the present invention.
Figure 3:
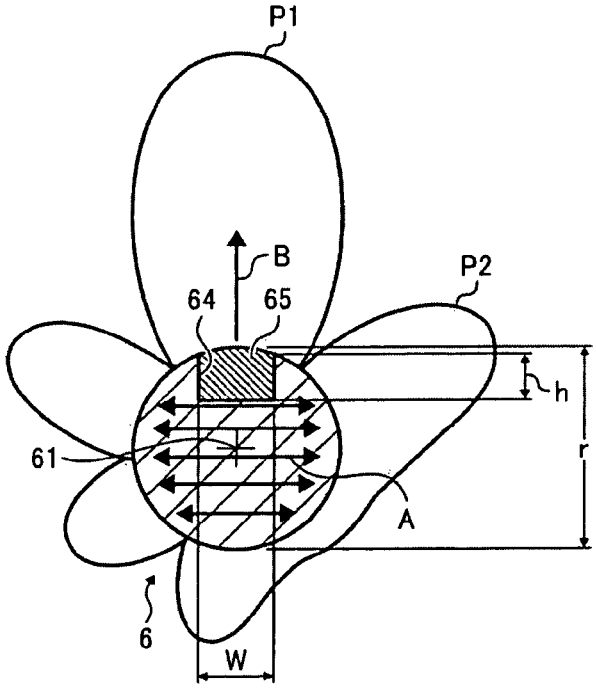
FIG. 3 is a sectional view in the direction perpendicular to the axial direction of the magnetic roller according to the first embodiment of the present invention.

FIGS. 1A, 1B are lateral sectional views each illustrating a developer carrier 4 according to the first embodiment of the present invention. FIG. 2 is a perspective view illustrating the developer carrier 4. FIG. 3 is a sectional view perpendicular to the axial direction of the developer carrier 4.

The developer carrier 4 includes a development sleeve 5 and a magnetic roller 6 disposed in the development sleeve 5.

The development sleeve 5 includes a cylindrical hollow body coaxially-disposed with the magnetic roller 6 as illustrated in FIG. 1A. The development sleeve 5 includes flange parts 51, 51 on the both end portions thereof, so that the development sleeve 5 is supported by the flange parts to be rotatable about the magnetic roller 6. The development sleeve 5 is made of a non-magnetic material such as aluminum or aluminum alloy. Such a material is excellent in terms of workability and lightness.

The magnetic roller 6 includes a solid-core roller having magnetic anisotropy in one direction (A direction in FIG. 3) orthogonal to a central axis 61 of the magnetic roller 6. A rare-earth magnetic block 65 is disposed in a concave groove 64 extending in the axial direction on the outer circumference face of the magnetic roller 6. The rare-earth magnetic block 65 is disposed such that the magnetic anisotropic direction of the rare-earth magnetic block 65 becomes the direction (B direction in FIG. 3) substantially orthogonal to the magnetic anisotropic direction (A direction in FIG. 3) of the magnetic roller 6. The magnetic roller 6 is fastened (does not rotate) to an after-described development device 3.

The magnetic roller 6 includes thin shaft parts 62, 62 on the both ends thereof and a columnar body part 63 integrally formed with the shaft parts 62, 62 between the shaft parts 62, 62 on the both ends. The shaft parts 62, 62 and the body part 63 thereby function as a magnet.

The shaft parts 62, 62 of the magnetic roller 6 are fastened to the development device 3. As described above, the development sleeve 5 is rotatably supported about the magnetic roller 6. If the development sleeve 5 rotates, the developer transferred onto the development sleeve 5 is fed to a development area formed between the developer carrier 4 and the photoreceptor drum.

In order to maintain the rigidity of the magnetic roller 6, the magnetic roller 6 is molded by means of injection molding which injects, for example, a material including plastic magnet, mixed anisotropic magnetic powder with a PA (polyamide) series resin (high polymer compound) having high rigidity into a die having an orientation magnetic field in one direction. By molding the magnetic roller 6 in the magnetic field, the material becomes anisotropic (the magnetic powder in the material is oriented in a predetermined direction), and the magnetic properties of the magnetic roller 6 are improved after molding.

In the present embodiment, as illustrated in FIGS. 2, 3, the rare-earth magnetic block 65 is disposed in the concave groove 64 extending in the axial direction on the outer circumference face of the magnetic roller 6. The rare-earth magnetic block 65 is formed as a block in a bar extending in the concave groove 64 along the axial direction of the magnetic roller 6. The rare-earth magnetic block 65 includes a bottom wall part 651, side wall parts 652, 653 rising from both sides of the bottom wall part 651, and a circular arc upper wall part 653 articulating the leading ends of the side wall parts 652, 652. The rare-earth magnetic block 65 is formed such that the width w of the bottom wall part 651 and the height h of each of the side wall parts 652, 652 are smaller than the diameter r of the magnetic roller 6. For this reason, the volume of the rare-earth magnetic block 65 is smaller than the volume of the magnetic roller 6.

In order to achieve a high magnetic force with a small volume, the rare-earth magnetic block 65 is formed of a material including plastic magnet, mixed the magnetic powder such as Nd—Fe—B or Sm—Fe—N with a high polymer compound of PA (polyamide) series of 6 PA. The rare-earth magnetic block 65 is molded by means of injection molding which injects a material into a die, but may be molded by means of extrusion molding, compression molding or the like.

When molding the rare-earth magnetic block 65, for example, the injection molding is conducted in the magnetic field. The material thereby becomes anisotropic, and high magnetic properties can be obtained. The magnetic body of the molded rare-earth magnetic block 65 is oriented toward the upper wall part 653 from the bottom wall part 651.

The rare-earth magnetic block 65 is constituted as a development main magnetic pole as the magnetic roller 6, and generates a sufficiently high magnetic force. The developer napped in the shape of a brush on the surface of the development sleeve 5 along the magnetic lines generated by the magnetic roller 6 is fed to the development area formed between the developer carrier and the photoreceptor drum.

In the present embodiment, as illustrated in FIG. 3, the rare-earth magnetic block 65 is disposed such that the magnetic anisotropic direction of the rare-earth magnetic block 65 becomes the direction (B direction in FIG. 3) substantially orthogonal to the magnetic anisotropic direction (A direction in FIG. 3) of the magnetic roller 6. More particularly, the rare-earth magnetic block has the magnetic anistropic direction (B direction in FIG. 3) substantially orthogonal to the magnetic anistropic direction (A direction in FIG. 3) of the magnetic roller 6.

The present inventors constitute the magnetic roller 6 with the solid-core roller having magnetic anisotropy in one direction, and also found that the magnetic pole except for the development main magnetic pole of the magnetic roller 6 can be constituted to have a high magnetic force in the magnetic roller having a reduced diameter by disposing the rare-earth magnetic block 65 such that the magnetic anisotropic direction of the rare-earth magnetic block 65 becomes the direction (B direction) substantially orthogonal to the magnetic anisotropic direction (A direction) of the magnetic roller 6.

More particularly, the present inventors found that the magnetic pole except for the development main magnetic pole can be constituted to have a high magnetic force by constituting the magnetic anisotropic direction (A direction) of the magnetic roller 6 and the magnetic anisotropic direction (B direction) of the rare-earth magnetic block 65 to be disposed in the magnetic roller 6 to have a predetermined relationship.

Figure 4:
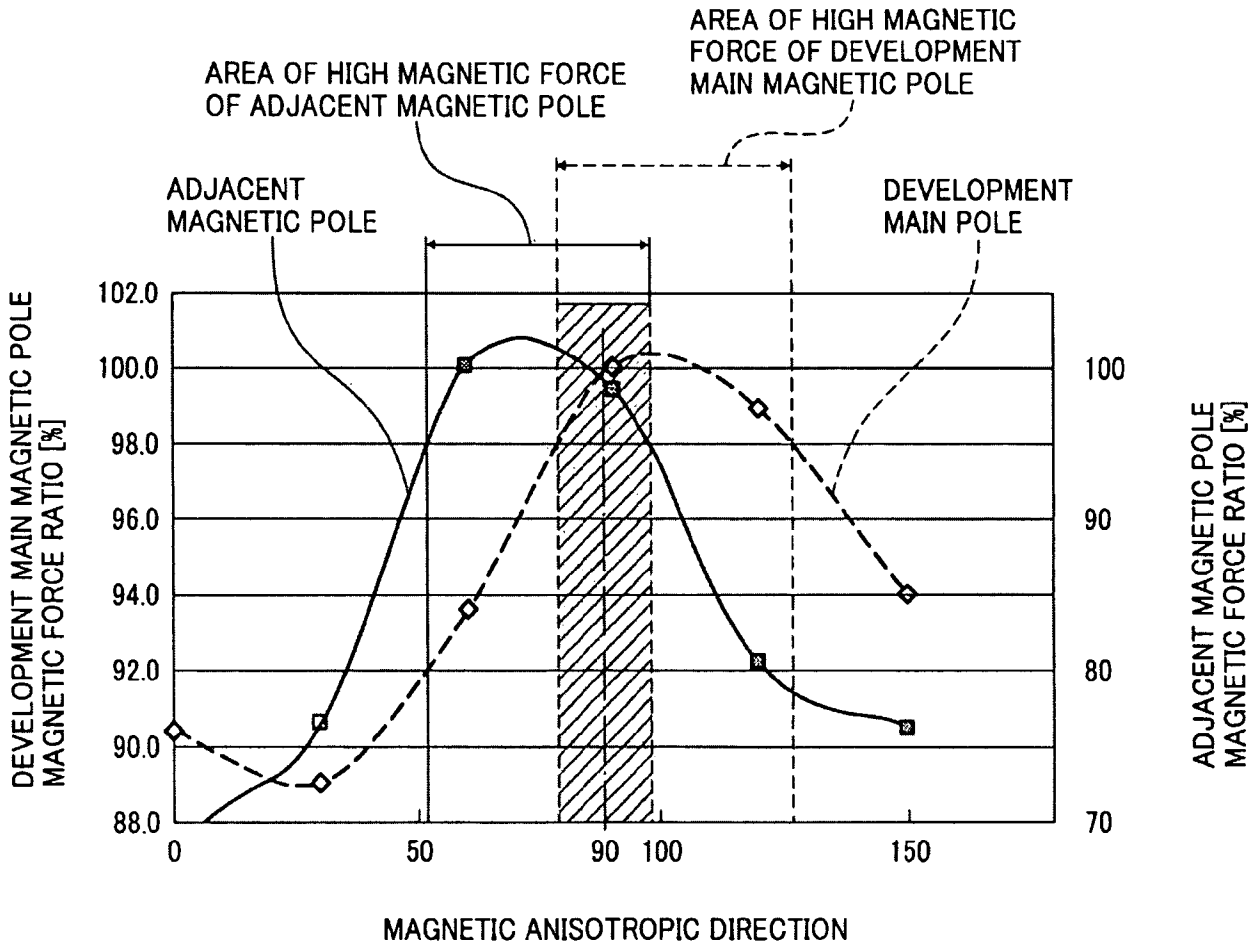
FIG. 4 is a graph illustrating the relationship among the magnetic anisotropic direction, the development main pole magnetic force ratio, and the adjacent pole magnetic force ratio of the magnetic roller according to the first embodiment of the present invention.

FIG. 4 is a graph illustrating a relationship among the magnetic anisotropic direction of the magnetic roller 6, the development main magnetic pole magnetic force ratio, and the magnetic force ratio of the magnetic pole adjacent to the development main magnetic pole (refer to adjacent magnetic pole magnetic force ratio).

It was found that when disposing the rare-earth magnetic block 65 such that the magnetic anisotropic direction of the rare-earth magnetic block 65 becomes the direction (B direction in FIG. 3) substantially orthogonal to the magnetic anisotropic direction (A direction in FIG. 3) of the magnetic roller 6, i.e., when disposing the rare-earth magnetic block 65 such that an angle between the magnetic anisotropic direction (B direction) of the rare-earth magnetic block 65 and the magnetic anisotropic direction (A direction) of the magnetic roller 6 forms 90 degrees, as illustrated in an area shown by the hatched lines in FIG. 4, not only the development main magnetic pole but also the magnetic pole adjacent to the development magnetic pole (adjacent magnetic pole) can be constituted to have a high magnetic force. In this case, in the area shown by the hatched lines in FIG. 4, it is identified that the development main magnetic pole magnetic force ratio and the adjacent magnetic pole magnetic force ratio become a high magnetic force such as 98% or more.

In the present embodiment, since the magnetic roller 6 is constituted of a solid-core roller, both of the shaft parts 62, 62 and the body part 63 of the magnetic roller 6 operate as a magnet. Therefore, the volume of a part operating as the magnet can be increased even if the magnetic roller 6 has a reduced diameter. Accordingly, the magnetic roller 6 having a strong magnet force can be obtained even if the magnetic roller 6 has a reduced diameter.

Moreover, in the present embodiment, the rare-earth magnetic block 65 is disposed in the concave groove 64 extending in the axial direction of the outer circumference face of the magnetic roller 6, so that the rare-earth magnetic block 65 is constituted as the development main magnetic pole of the magnetic roller 6. For this reason, even if the magnetic roller 6 has a reduced diameter, a sufficiently high magnetic force can be produced in the development main magnetic pole.

Figure 5:
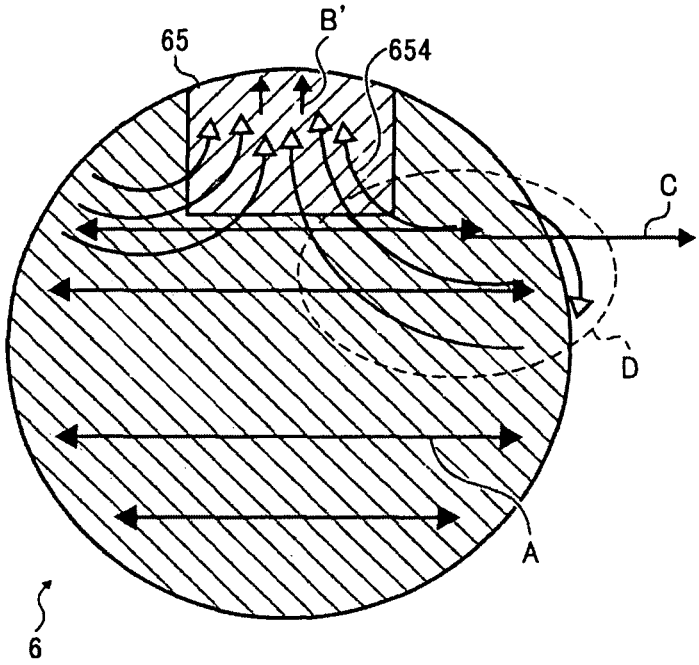
FIG. 5 is a vertical sectional view of the axial direction of the magnetic roller according to the first embodiment of the present invention, describing the magnetic lines when the magnetic anisotropic direction of the rare-earth magnetic block is disposed in a direction substantially orthogonal to the magnetic anisotropic direction of the magnetic roller.
Figure 6:
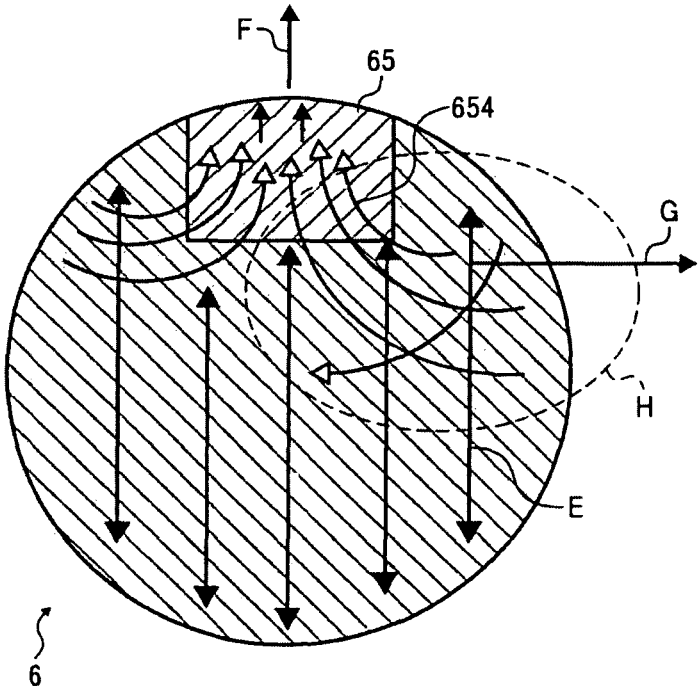
FIG. 6 is a vertical sectional view of the axial direction of the magnetic roller according to the first embodiment of the present invention, describing the magnetic lines when the magnetic anisotropic direction of the rare-earth magnetic block is disposed in a direction substantially parallel to the magnetic anisotropic direction of the magnetic roller.

FIGS. 5, 6 are views each of which illustrates the directions of the magnetic lines in the sectional view perpendicular to the axial direction of the magnetic roller 6.

In the present embodiment, the rare-earth magnetic block 65 is disposed such that the magnetic anisotropic direction of the rare-earth magnetic block 65 becomes the direction (B direction in FIG. 3) substantially orthogonal to the magnetic anisotropic direction (A direction in FIG. 3) of the magnetic roller 6. More particularly, as illustrated in FIG. 5, the orientation direction (B' direction in FIG. 5) of the magnetic body of the rare-earth magnetic block 65 is substantially orthogonal to the orientation direction (A direction) of the magnetic body of the magnetic roller 6. For this reason, in the magnetic roller 6, a part (D part in FIG. 5) in which the direction (C direction in FIG. 5) of the magnetic lines 654 formed in the rare-earth magnetic block 65 and the orientation direction (A direction) of the magnetic body of the magnetic roller 6 become parallel is generated, so that the magnetic force in this part can be increased. Especially, as illustrated in FIG. 3, the adjacent magnetic pole P2 of a part of the magnetic roller on the reverse-rotation direction side (hereinafter, refer to a downstream side) adjacent to the rare-earth magnetic block 65 functioning as the development main magnetic pole P1 can be constituted to have a high magnetic force.

On the other hand, as illustrated in FIG. 6, when the rare-earth magnetic block 65 is disposed such that the magnetic anisotropic direction of the rare-earth magnetic block 65 becomes the direction (F direction in FIG. 6) substantially parallel to the magnetic anisotropic direction (E direction in FIG. 6) of the magnetic roller, in the magnetic roller 6, the direction (G direction in FIG. 6) of magnetic force lines 654 formed in the rare-earth magnetic block 65 is a direction orthogonal to the orientation direction (E direction) of the magnetic body of the magnetic roller 6 in the H part in FIG. 6. For this reason the magnetic force in this part can not be increased.

As described above, if the magnetic force of the adjacent magnetic pole P2 on the downstream side of the development main magnetic pole P1 increases (refer to FIG. 3), when the developer moves away from the photoreceptor drum 23 in the development area 41 (refer to FIG. 9), the magnetic carriers of the developer are attracted by the high magnetic force of the magnetic force of the adjacent magnetic pole P2. Therefore, the magnetic carriers of the developer can be prevented from adhering onto the photoreceptor drum 23. Accordingly, unnecessary magnetic carriers can be prevented from adhering onto the photoreceptor drum 23, and an image having a high quality can be obtained.

More particularly, in the present embodiment, since the magnetic flux density of the adjacent magnetic pole P2 positioned on the downstream side of the development main magnetic pole P1 of the magnetic roller 6 is constituted to be equal to the magnetic flux density of the development main magnetic pole P1, not only the development main magnetic pole P1 constituted of the rare-earth magnetic block 65 but also the adjacent magnetic pole P2 on the downstream side of the rare-earth magnetic block 65 can be constituted to have a high magnetic force. Herewith, when the developer separates from the photoreceptor drum 23 in the development area 41, the magnetic carriers of the developer are attracted by the high magnetic force of the adjacent magnetic pole P2. Accordingly, the magnetic carriers of the developer can be prevented from adhering onto the photoreceptor drum 23. Therefore, unnecessary carriers can be prevented from adhering onto the photoreceptor drum 23, and a high quality image can be obtained.

Next, the molding method of the magnetic roller 6 will be described.

As described above, the magnetic roller 6 includes the solid core roller having magnetic anisotropy in one direction orthogonal to the central axis 61 of the magnetic roller 6.

Figure 7:
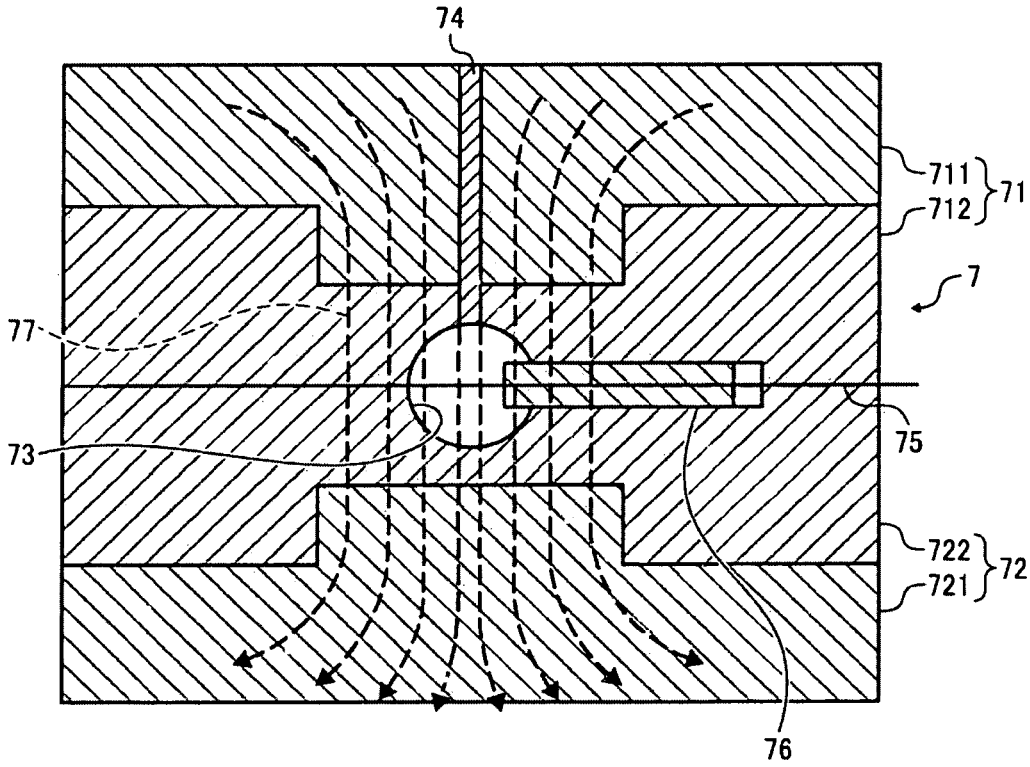
FIG. 7 is a schematic view illustrating a die for forming the magnetic roller according to the first embodiment of the present invention.

In the present embodiment, as illustrated in FIG. 7, the magnetic roller 6 is molded by means of injection molding which injects a mixed material including magnetic powder and a high polymer compound into an injection molding die 7 having an orientation magnetic field in one direction. For example, the magnetic roller 6 is molded by means of injection molding which injects a material including plastic magnet, mixed anisotropic magnetic powder with a PA (polyamide) series resin (high polymer compound) having high rigidity into the injection molding die 7 having an orientation magnetic field in one direction.

The injection molding die 7 is a split mold including a split mold 71 and a split mold 72. Each of the split molds 71, 72 includes a magnetic insert 711, 721 and a non-magnetic insert 712, 722. Each of the non-magnetic inserts 712, 722 is attached inside each of the magnetic inserts 711, 721. By combining the spilt molds 71, 72, a cavity 73 for molding the magnetic roller 6 is constituted.

The split mold 71 is provided with an ejector-pin 74 for removing the molded magnetic roller 6 from the split mold 71. A portion of a parting line 75 of the split molds 71, 72 is provided with a slide-core 76 for forming the concave groove 64 on the outer circumference face of the magnetic roller 6 when molding the magnetic roller 6.

The magnetic roller 6 is molded by means of injection molding which injects the above-described material including the plastic magnet, mixed anisotropic powder with the PA (polyamide) series resin (high polymer compound) into the injection molding die 7. In this case, by molding the magnetic roller 6 in the magnetic field having a stream 77 of the magnetic field in one direction toward the magnetic insert 721 of the split mold 72 from the magnetic insert 711 of the split mold 71, the magnetic powder in the material is oriented along the stream 77 of the magnetic field, and the magnetic roller 6 is molded to have the magnetic anisotropy in one direction.

Figure 8A:
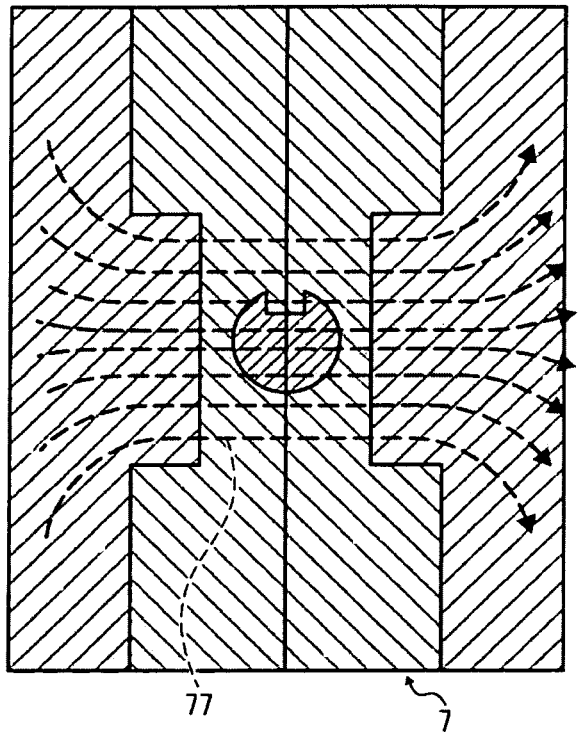
FIG. 8A is a view illustrating a manufacturing process of the magnetic roller according to the first embodiment of the present invention, describing a process for forming the magnetic roller by means of magnetic field forming.
Figure 8B:
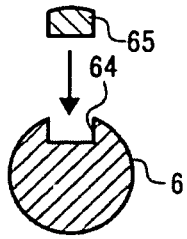
FIG. 8B is a view describing a process for disposing the rare-earth magnetic block to be fastened in the formed magnetic roller according to the first embodiment of the present invention.
Figure 8C:
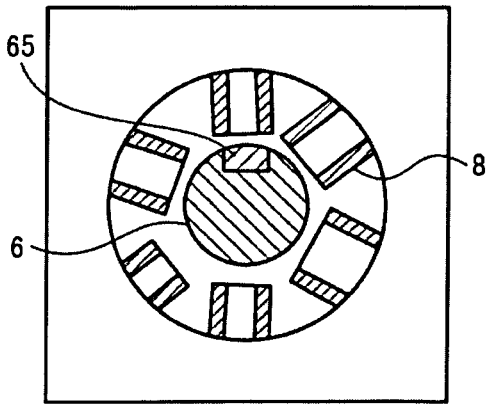
FIG. 8C is a view describing a process for magnetizing the magnetic roller provided with the rare-earth magnetic block according to the first embodiment of the present invention.

As illustrated in FIG. 8B, the rare-earth magnetic block 65 in a bar is disposed to be fastened in the concave groove 64 of the magnetic roller 6 molded in the magnetic field. The magnetic roller 6 in which the rare-earth magnetic block 65 is disposed is arranged in a magnetizing yoke 8 as illustrated in FIG. 8C, and the magnetic roller 6 is magnetized to include multi-poles having the magnetic lines as illustrated in FIG. 5.

In this case, adhesive agent is used for fastening the rare-earth magnetic block 65 to the magnetic roller 6. In addition, the rare-earth magnetic block 65 can be fastened to the magnetic roller 6 after magnetizing the magnetic roller 6 by means of the magnetizing yoke 8.

In the present embodiment, the magnetic roller 6 is molded by means of injection molding which injects a mixture material including magnetic powder and a high polymer compound into the injection molding die 7 having an orientation magnetic field in one direction. Accordingly, the injection molding die 7 of the magnetic roller 6 can be adopted as a die including a simple structure having the magnetic field in one direction, and the manufacturing costs for the die can be reduced.

Moreover, when molding the magnetic roller 6 by means of injection molding, the shaft parts 62, 62 and the body part 63 can be integrally molded at the same time, so the manufacturing process for the magnetic roller 6 can be reduced. Accordingly, the processing costs for the magnetic roller 6 can be controlled.

In order to feed the developer onto the photoreceptor drum 23 by the development sleeve 5 of which the surface carries the developer, the roughening process is conducted on the surface of the development sleeve 5, and the surface includes a plurality of recesses. As the method of the roughening process, a sandblast process or a beadblast process can be used.

Since the developer carrier 4 according to the present embodiment has a reduced diameter as described above, the development sleeve 5 of the developer carrier 4 has a small diameter. If the roughening process for performing a surface process from one direction such as the sandblast process or a beadblast process is conducted on the outer surface of the development sleeve 5 having a reduced diameter, the development sleeve 5 curves. For this reason, there is a problem in that it is difficult to achieve deflection accuracy (20 μm to 30 μm) required for actual use.

Consequently, the roughening process is performed on the development sleeve 5 having a reduced diameter by using an electromagnetic-blast process as the method of the roughening process of the outer surface of the development sleeve 5 already proposed by the present inventors. In this roughening process, a plurality of recesses are formed on the outer surface of the development sleeve 5 by randomly crushing short linear materials disposed in a rotation magnetic field onto the outer surface of the development sleeve 5 by the rotation magnetic field. According to this roughening process, the roughening process onto the outer surface can be equally conducted from the entire circumference of the outer surface of the development sleeve 5, and thus, the highly accurate development sleeve 5 having a reduced diameter without having curves can be obtained.

More particularly, according to the present invention, the development sleeve 5 includes a plurality of recesses formed by the electromagnetic-blast process on the outer surface, so the feeding amount of the developer can be uniformed, and a high quality image without having an uneven concentration can be obtained.

Figure 9:
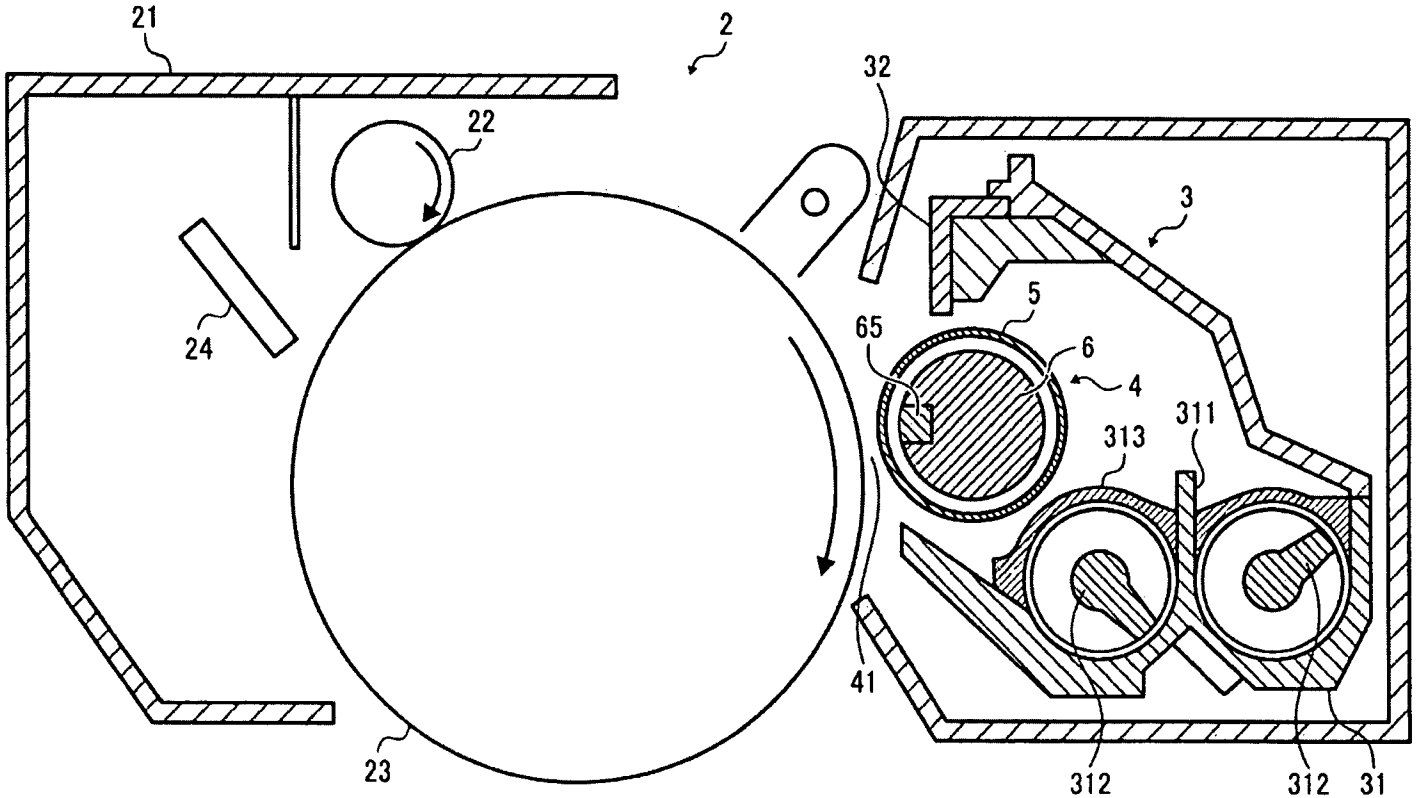
FIG. 9 is a schematic view illustrating a development device having a developer carrier according to the first embodiment of the present invention, and a processing cartridge having the development device.

FIG. 9 illustrates the development device having the development carrier 4 according to the present embodiment and a processing cartridge 2 having the development device 3.

The processing cartridge 2 includes a cartridge case 21, a charging roller 22, the photoreceptor drum 23, a cleaning device 24, and the development device 3. The cartridge case 21 includes inside thereof the charging roller 22, the photoreceptor drum 23, the cleaning device 24, and the development device 3. This cartridge case 21 is detachable relative to an after-mentioned image forming apparatus 1. Four processing cartridges 2 corresponding to yellow, magenta, cyan and black, respectively, are built in the after-mentioned image forming apparatus 1.

The development device 3 includes a developer supplying member 31, a developer controlling member 32 and the above-described developer carrier 4. The developer supplying member 31 includes a containing tank 311 and agitation members 312, 312. The containing tank 311 contains a two-component developer 313 mixed non-magnetic toner with magnetic carriers.

The developer carrier 4 of the development device 3 is disposed to face the photoreceptor drum 23. The developer carrier 4 transfers to its surface the developer 313 agitated in the containing tank 311. Then, the developer carrier 4 transfers the developer 313 having a predetermined thickness by means of the developer controlling member 32 onto the photoreceptor drum 23 at the development area 41. More particularly, the developer carrier 4 feeds the developer 313 transferred onto the surface of the developer carrier 4 to be napped in the shape of a brush to the development area 41 provided between the developer carrier 4 and the photoreceptor drum 23, and develops the electrostatic latent image on the photoreceptor drum 23.

In the present embodiment, the development device 3 has the above-described developer carrier 4. Therefore, the entire developer device 3 can be downsized.

Moreover, even if the developer carrier 4 of the development device 3 includes a reduced diameter, the magnetic roller 6 has a high magnetic force. For this reason, a sufficient amount of the developer can be uniformly fed, and a high quality image without having an uneven concentration can be obtained.

Since the electromagnetic-blast process is conducted when conducting the roughening process on the development sleeve 5, the development sleeve 5 does not curve even if the roughening process is conducted, and a highly accurate shape of the development sleeve 5 is maintained. For this reason, a high deflection accuracy of the development device 5 can be maintained. Accordingly, the generation of an irregular image such as a faint image can be prevented, and a high quality image can be obtained.

Moreover, the decrease in the feeding amount of the developer with time can be controlled.

In the present embodiment, the processing cartridge 2 includes the above-described development device 3. Therefore, the entire processing cartridge 2 can be downsized.

Moreover, even if the developer carrier 4 of the development device 3 has a reduced diameter, the magnetic roller 6 has a high magnetic force. For this reason, a sufficient amount of the developer can be uniformly fed, and the processing cartridge 2 for obtaining a high quality image without having an uneven concentration can be achieved.

Furthermore, since the electromagnetic-blast process is used when conducting the roughening process on the development sleeve 5, the development sleeve 5 does not curve even if the roughening process is conducted, and a highly accurate shape of the development sleeve 5 is maintained. For this reason, a high deflection accuracy of the development sleeve 5 can be maintained. Accordingly, the generation of an irregular image such as a faint image can be prevented, and the processing cartridge 2 for obtaining a high quality image can be achieved.

Figure 10:
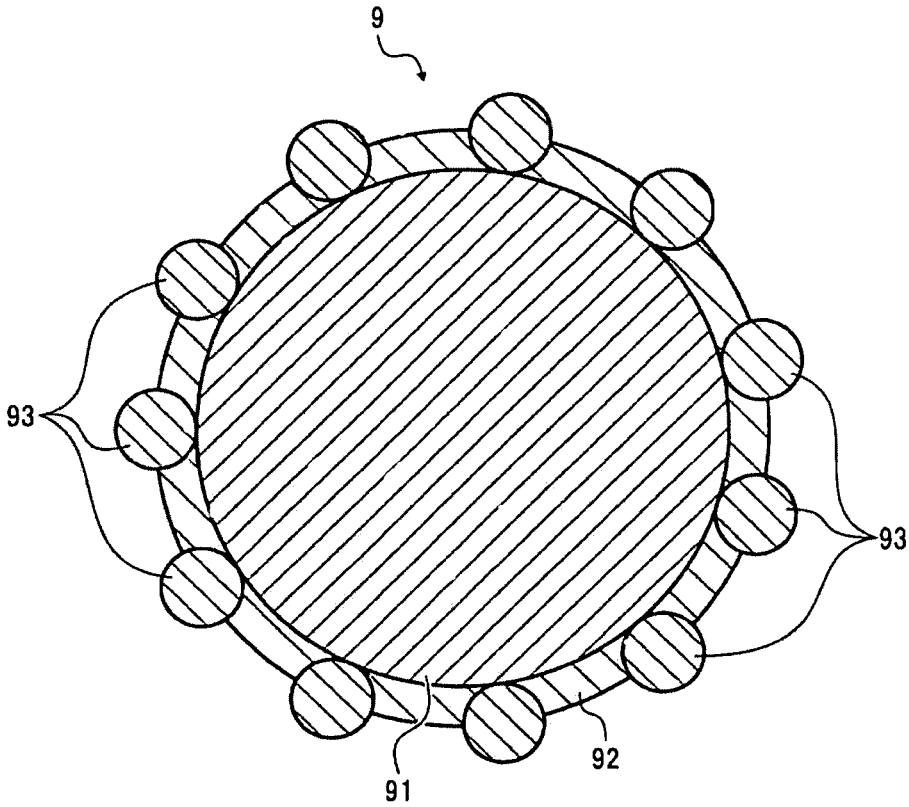
FIG. 10 is a sectional view illustrating a magnetic carrier for use in the developer of the development device having the developer carrier according to the first embodiment of the present invention.

FIG. 10 illustrates a magnetic carrier 9 for use in the developer 313 of the development device 3 having the developer carrier 4 according to the present embodiment.

The magnetic carrier 9 includes a center core 91, a resin film 92 for coating the outer surface of the center core 91, and alumina particles 93 dispersed into the resin film 92. The developer 313 of the development device 3 includes the magnetic carriers 9 and toner.

The center core 91 includes ferrite as a magnetic material and is formed in a spherical form. The resin film 92 coats the entire outer surface of the center core 91. The resin film 92 contains a resin component in which a thermoplastic resin such as acrylic and melamine resin are cross-linked and charging adjuster. The resin film 92 has elasticity and a strong adhesion force. Each of the alumina particles 93 is formed in a spherical shape having an outer diameter larger than the thickness of the resin film 92. This alumina particle 93 is retained by the strong adhesive force of the resin film 92. The alumina particles 93 project to the outer circumference side of the magnetic carrier 9 from the resin film 92.

The average particle diameter of the magnetic carrier 9 is 20 μm or more and 50 μm or less. If the average particle diameter of the magnetic carrier 9 is less than 20 μm, the magnetization degree of the magnetic carrier 9 decreases. Therefore, the magnetic binding force that the magnetic carrier 9 receives from the developer carrier 4 decreases. For this reason, the magnetic carrier 9 is easily absorbed onto the photoreceptor drum 23. This is an undesirable situation. Moreover, if the average particle diameter of the magnetic carrier 9 exceeds 50 μm, the electric field between the magnetic carrier 9 and the electrostatic latent image on the photoreceptor drum 23 becomes weak, so that an even image can not be obtained and also an image quality is deteriorated. This is an undesirable situation.

In the present embodiment, the developer 313 includes the toner and magnetic carriers 9. In addition, since the average particle diameter of the magnetic carrier 9 is 20 μm or more and 50 μm or less, which is superior in granularity, a high quality image with less irregularity can be obtained.

Figure 11:
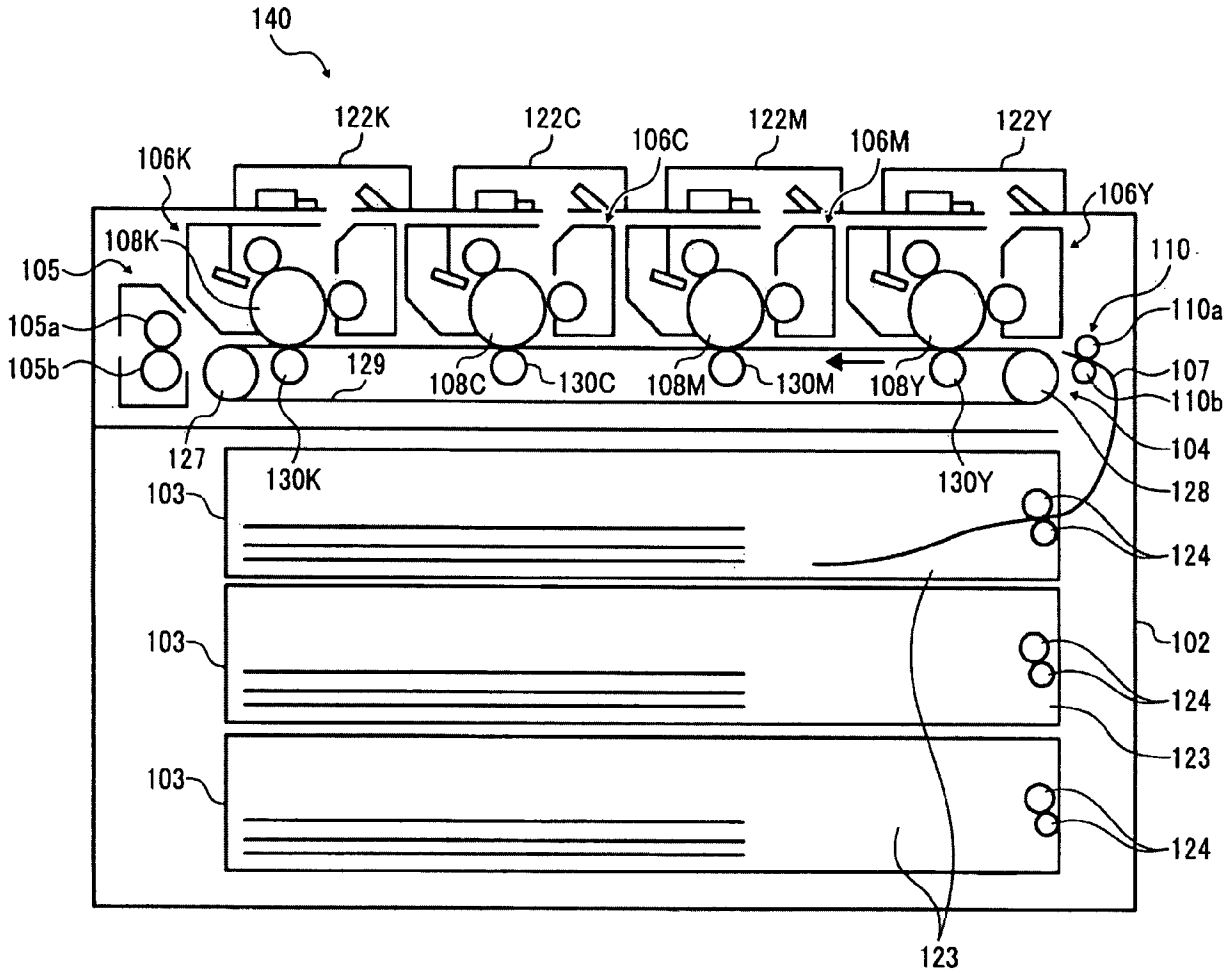
FIG. 11 is a schematic view illustrating an image forming apparatus in which the processing cartridge including the development device having the developer carrier according to the first embodiment of the present invention is disposed.

FIG. 11 shows the image forming apparatus 1 according to the first embodiment of the present invention.

The image forming apparatus 1 includes at least processing cartridges 106Y, 106M, 106C, 106K, laser writing devices 122Y, 122M, 122C, 122K, a transferring unit 104, and a fixing unit 105. In this case, each of the processing cartridges 106Y, 106M, 106C, 106K includes the above-described development device 3. Accordingly, the small image forming apparatus 1 capable of obtaining an image free from irregularity can be provided at low cost.

In the image forming apparatus 1, an image using each of colors, yellow (Y), magenta (M), cyan (C), and black (B), i.e., a color image is formed on a recording paper 107 as one transferring member. In FIG. 11, the units, etc., corresponding to yellow, magenta, cyan, and black, respectively, are presented by Y, M, C, and K marked at the ends of the reference numbers, respectively.

A body 102 of image forming apparatus is formed in the shape of a box, for example, and is placed on a floor. The body 102 of the image forming apparatus houses paper supply units 103, a resist roller pair 110, the transferring unit 104, the fixing unit 105, a plurality of laser writing units 122Y, 122M, 122C, 122K, and a plurality of processing cartridges 106Y, 106M, 106C, 106K.

A plurality of paper supply units 103 is disposed in the lower portion of the body 102 of the image forming apparatus. Each of the paper supply units 103 houses the recording papers 107 in stacks, and includes a paper supply cassette 123, which can be placed in the body of the image forming apparatus and taken out from the body 102 of the image forming apparatus, and a paper supply roller 124. This paper supply roller 124 is pressed against the top recording paper 107 in the paper supply cassette 123. The paper supply roller 124 sends the top recording paper 107 between the after-mentioned feeding belt of the transferring unit 104 and each of the photoreceptor drums 108Y, 108M, 108C, 108K in each of the processing cartridges 106Y, 106M, 106C, 106K.

The resist roller pair 110 is disposed in the feeding path of the recording paper 107 to be fed from the paper supply unit 103 to the transferring unit 104, and includes a pair of rollers 110*a*, 110*b*. The resist roller pair 110 sandwiches the recording paper 107 between a pair of rollers 110*a*, 110*b*, and sends the sandwiched recording paper 107 between the transferring unit 104 and the processing cartridges 106Y, 106M, 106C, 106K at the time for overlapping the toner image.

The transferring unit 104 is disposed above the paper supply units 103. The transferring unit 104 includes a driving roller 127, a driven roller 128, a feeding belt 129, and transfer rollers 130Y, 130M, 130C, 130K. The driving roller 127 is disposed on the downstream side of the feeding direction of the recording paper 107, and rotates by means of a motor as a driving source. The driven roller 128 is rotatably supported in the body 102 of the image forming apparatus, and is disposed on the upstream side of the feeding direction of the recording paper 107. The feeding belt 129 is formed in an endless circularity, and is stretched to the driving roller 127 and the driven roller 128. The feeding belt 129 circulates (endless running) in the counter-clockwise direction in FIG. 19 around the driving roller 127 and the driven roller 128 by the rotation of the driving roller 127.

Each of the transfer rollers 130Y, 130M, 130C, 130K is disposed in a position which sandwiches the feeding belt 129 and the recording paper 107 on the feeding belt 129 with each of the photoreceptor drums 108Y, 108M, 108C, 108K of each of the processing cartridges 106Y, 106M, 106C, 106K. In the transferring unit 104, each of the transfer rollers 130Y, 130M, 130C, 130K presses the recording paper 107 sent from the paper supply unit 103 against the outer surface of each of the photoreceptor drums 108Y, 108M, 108C, 108K, and transfers the toner image on each of the photoreceptor drums 108Y, 108M, 108C, 108K onto the recording paper 107. The transferring unit 104 sends the recording paper 107 onto which the toner image is transferred toward the fixing unit 105.

The fixing unit 105 is disposed on the downstream side of the feeding direction of the transfer paper 107 in the transferring unit 104, and includes a pair of rollers 105*a*, 105*b* which sandwich the transfer paper 107 therebetween. The fixing unit 105 presses and heats the recording paper 107 sent between a pair of the rollers 105*a*, 105*b* from the transferring unit 104, so as to fix the toner image transferred onto the recording paper 107 from the photoreceptor drums 108Y, 108M, 108C, 108K onto the recording paper 107.

Each of the laser writing units 122Y, 122M, 122C, 122K is arranged in the upper portion of the apparatus body 102. Each of the laser writing units 122Y, 122M, 122C, 122K corresponds to each of the processing cartridges 106Y, 106M, 106C, 106K. Each of the laser writing units 122Y, 122M, 122C, 122K illuminates laser light onto the outer surface of each of the photoreceptor drums 108Y, 108M, 108C, 108K uniformly charged by the charging roller of each of the processing cartridges 106Y, 106M, 106C, 106K, so as to form an electrostatic latent image.

Each of the processing cartridges 106Y, 106M, 106C, 106K is disposed between the transferring unit 104 and each of the laser writing units 122Y, 122M, 122C, 122K. The processing cartridges 106Y, 106M, 106C, 106K are detachably attached to the body 102 of the image forming apparatus. In addition, the processing cartridges 106Y, 106M, 106C, 106K are arranged in parallel along the feeding direction of the recording paper 107.

In the present embodiment, the image forming apparatus 1 includes the above-described development device 3. Therefore, the entire image forming apparatus 1 can be downsized.

Moreover, even if the developer carrier 4 of the development device 3 has a reduced diameter, the magnetic roller 6 has a high magnetic force. For this reason, a sufficient amount of the developer can be uniformly fed, and the image forming apparatus 1 capable of obtaining a high quality image free from an uneven concentration can be achieved.

Moreover, since the electromagnetic-blast process is used when conducting the roughening process on the development sleeve 5, the development sleeve 5 does not curve even if the roughening process is conducted, and a highly accurate shape of the development sleeve 5 can be maintained. For this reason, the development sleeve 5 having high deflection accuracy can be maintained. Accordingly, the generation of an irregular image such as a faint image is prevented and the image forming apparatus 1 capable of obtaining a high quality image can be achieved.

Furthermore, the decrease in the feeding amount of the developer with time can be controlled.

Embodiment 1-1

A solid-core magnetic roller, 8.5 mm in diameter and 300 mm in length in the axial direction, having a groove, 2 mm in width in the outer circumference axial direction and 2.5 mm in depth was molded by means of injection molding in the 0.7 T orientation magnetic field at a 300° C. resin temperature and 220 MPa injection pressure by using a plastic magnet material (manufactured by Toda Kogyo Corporation, TP-S68) mixed 6 PA with anisotropic Sr ferrite powder. After that, a rare-earth magnetic block including a plastic magnet material of Nd—Fe—B series of BHmax12 was disposed to be fastened into the groove of the magnetic roller such that the magnetic anisotropic direction of the magnetic roller becomes the direction substantially orthogonal to the magnetic anisotropic direction of the rare-earth magnetic roller. Then, five poles were magnetized in the circumference direction of the roller, and the magnetic roller was obtained.

On the other hand, the roughening process (electromagnetic-blast process) was conducted on the outer surface of the cylindrical body including an aluminum material (A6063) of 10 amm in outer diameter and 9 mm in inner diameter by crushing linear materials each including SUS 304 of 0.8 mm in outer diameter and 5 mm in length. The cylindrical body was adopted as a development sleeve having Rz10μ surface roughness and 12 μm deflection accuracy. Then, the above-described magnetic roller was disposed inside the development sleeve, and a developer carrier was obtained.

Comparative Example 1-1

A developer carrier was obtained similar to the first embodiment, provided that a development sleeve having Rz10μ surface roughness and 25μ deflection accuracy was obtained by molding a magnetic roller onto an outer circumference of a core of 5 mm in diameter by means of extrusion molding without an orientation electric field, and roughening of the development sleeve by the sandblast process using #120 abrasive grains.

Comparative Example 1-2

A developer carrier was obtained similar to the first embodiment, provided that a magnetic roller was molded onto an outer circumference of a core of 5 mm in diameter by means of extrusion molding without an orientation magnetic field.

Comparative Example 1-3

A developer carrier was obtained similar to the first embodiment, provided that a development sleeve having Rz10μ surface roughness and 25μ deflection accuracy was obtained by roughening the development sleeve by the sandblast process using #120 abrasive grains without an orientation magnetic field.

The magnetic properties were evaluated among the first magnetic roller in the embodiment 1-1, the second magnetic rollers in the comparative examples 1-1, 1-2, and the third magnetic roller in the comparative example 1-3, and the evaluation results are presented in Table 1.

TABLE 1

| | structure | | | magnetic force | | |
|---|---|---|---|---|---|---|
| | pattern diagram | magnetic roller | rare-earth magnetic block | development main pole magnetic force | adjacent pole magnetic force | evaluation |
| first magnetic roller | 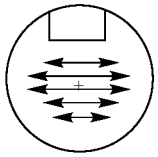 | anisotropic injection molding | 6PA + anisotropy Nd—Fe—B magnetic powder | 125 mT | 80 mT | ⊙ |
| second magnetic roller | 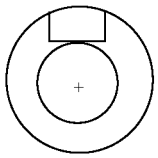 | isotropic extrusion molding | 6PA + anisotropy Nd—Fe—B maagnetic powder | 110 mT | 60 mT | Δ |
| third magnetic roller | 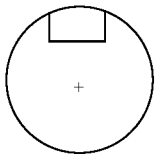 | isotropic injection molding | 6PA + anisotropy Nd—Fe—B magnetic powder | 120 mT | 70 mT | ○ |

According to Table 1, even if the first magnetic roller in the embodiment 1-1 has a reduced diameter, the highest magnetic force can be obtained.

The development sleeve accuracy was compared between the first development sleeve on which the electromagnetic-blast process in the embodiment 1-1 was conducted and the second development sleeve on which the sandblast process in the comparative example 1-1 and the comparative example 1-3 was conducted. The comparison results are presented in Table 2 and FIG. 12.

TABLE 2

| | condition | | | | | |
|---|---|---|---|---|---|---|
| | sleeve material | process method | condition | deflection | roughness | evaluation |
| first development sleeve | A 6063 | electromagnetic-blast ø O. 8 × 5 SUS 304 media | frequency 100 Hz generation magnetic field 50~120 mT | 8~20 μm | 3~20 μm | ◎ |
| second development sleeve | A 6063 | sandblast #120 abrasive grain | discharge pressure 0.1~0.3 MPa | 8~65 μm | 3~17 μm | X |

Figure 12:
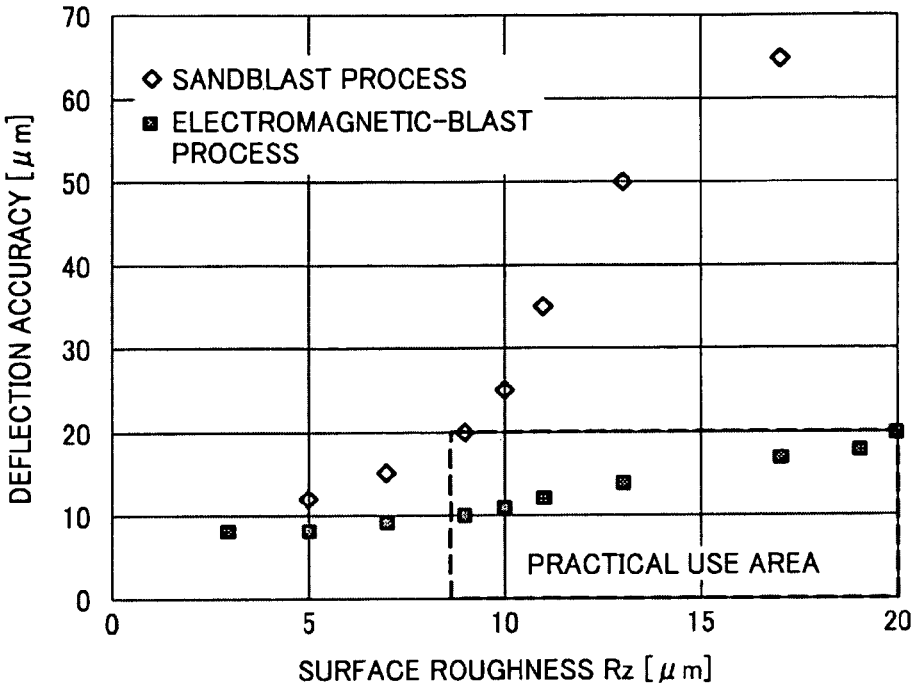
FIG. 12 is a graph illustrating a relationship between surface roughness Rz and deflection accuracy in an electromagnetic-blast process and a sandblast process.

According to Table 2 and FIG. 12, when using the sandblast process, the deflection accuracy deteriorates as the surface roughness increases. Therefore, it is impossible to reach Rz8μ surface roughness or more and 30μ deflection accuracy or less, which are the practical use ranges. On the other hand, when using the electromagnetic-blast process, even if the surface roughness is Rz10μ, the deflection accuracy is 20μ or less. Therefore, it has confirmed that the development sleeve onto which the electromagnetic-blast process is conducted is sufficiently sustainable for practical use.

Figure 13:
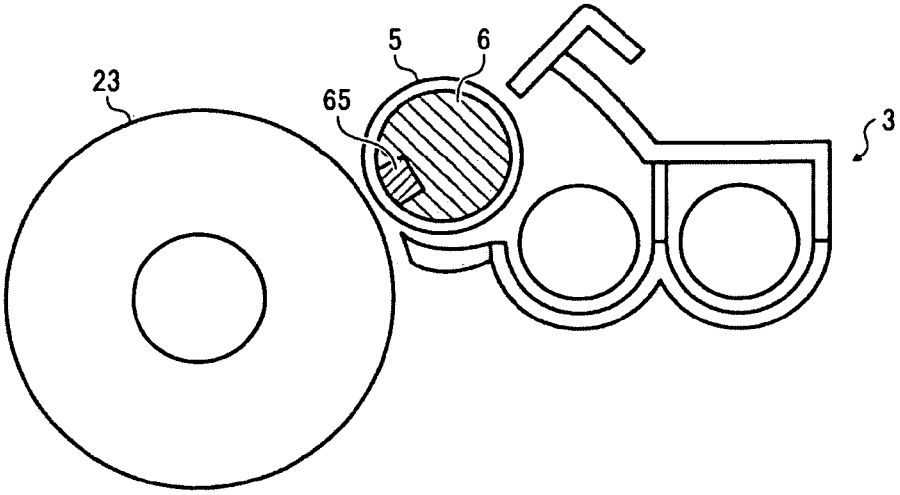
FIG. 13 is a schematic view illustrating a development device used for confirming the performance of the developer carrier according to the first embodiment of the present invention.

Moreover, the confirmation of the image irregularities and the magnetic carrier adhesion were conducted in the development device 3 illustrated in FIG. 13 by using each of the developer carriers in the embodiment 1-1 and the comparative examples 1-2, 1-3. The evaluation results are presented in Table 3.

TABLE 3

| | condition | | image | magnetic carrier | |
|---|---|---|---|---|---|
| | magnetic roller | development sleeve | irregularity | adhesion | evaluation |
| embodiment 1-1 | first magnetic roller | first development sleeve roughness 10μ deflection 12μ | ◎ (no irregularity) | ◎ (A) (no irregularity) | ◎ |
| comparative example 1-1 | second magnetic roller | second development sleeve roughness 10μ deflection 25μ | X (irregularity) | X (A) (irregularity) | X |
| comparative example 1-2 | second magnetic roller | first development sleeve roughness 10μ deflection 12μ | ◎ | X | Δ |
| comparative example 1-3 | first magnetic roller | second development sleeve roughness 10μ deflection 25μ | X | ◎ | Δ |

According to Table 3, it can be confirmed that the developer carrier in the embodiment 1-1 has a high magnetic force and causes no problems such as image irregularities and magnetic carrier adhesion even if the developer carrier in the embodiment 1-1 has a reduced diameter.

Second Embodiment

Figure 14:
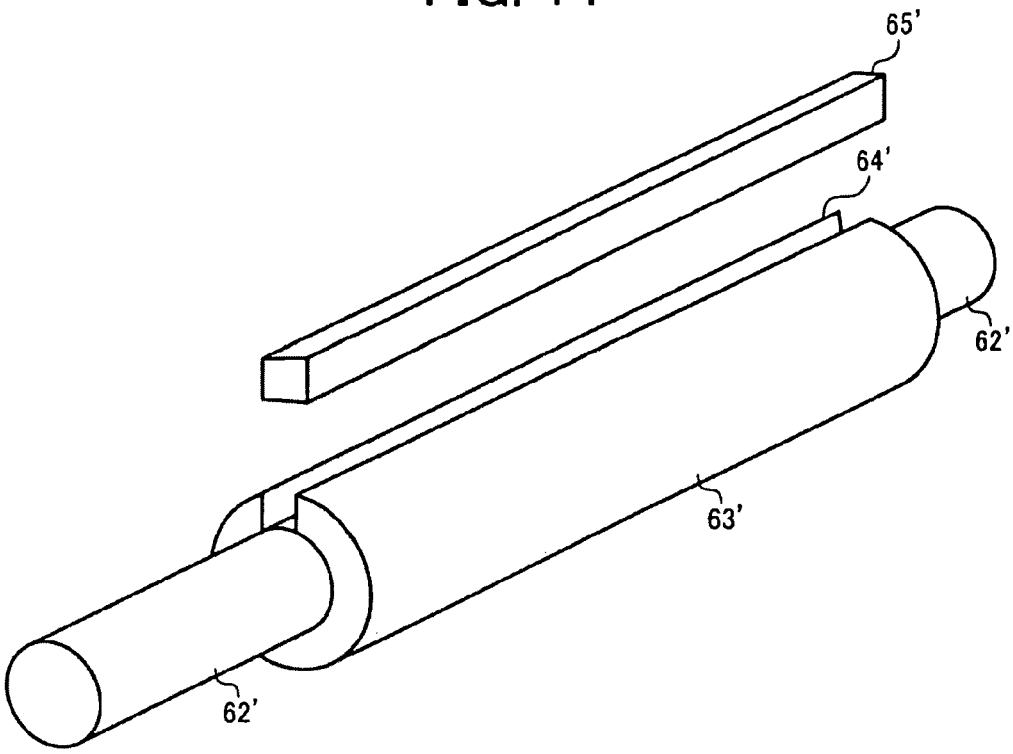
FIG. 14 is a perspective view illustrating a magnetic roller according to a second embodiment of the present invention.

FIG. 14 is a view illustrating a structural example according to the second embodiment of the present invention.

The present embodiment illustrates a magnetic roller 6' made of plastic magnet having shaft parts 62', 62' disposed integrally on both ends of a columnar body part 63', respectively. A rare-earth magnetic block 65' (in this example, a compact including rare-earth magnet powder and resin) is buried in a part of the circumference face of the body part 63' provided with a concave groove 64' for housing the rare-earth magnetic block 65' along the axis.

Figure 15:
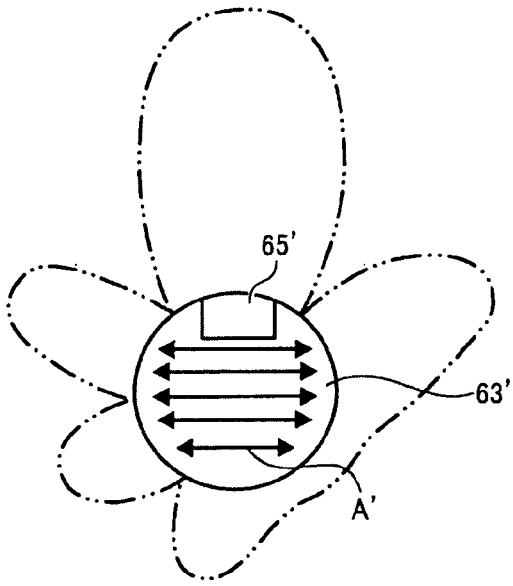
FIG. 15 is a vertical sectional view of the axial direction of the magnetic roller according to the second embodiment of the present invention, illustrating the orientation directions of the magnetism.

The magnetism of the magnetic roller 6' is oriented in one direction A' as illustrated by the arrows in FIG. 15. More particularly, the magnetic roller 6' includes magnetic anisotropy in the one direction. In this case, if the manufacturing method for molding the magnetic roller by means of injection molding while applying a magnetic field is used, the shaft parts are magnetized because the material of the shaft parts is the same as the material of the body part. As a result, there may be a case in which various problems arise because the developer is easily attracted onto the shaft parts. However, according to the present embodiment, since the axial parts are not magnetized, the attraction of the developer onto the shaft parts is prevented. Moreover, no drastic difference is generated in the magnetic flux density distribution in the axial direction of the body part 63', so a preferable image is formed when applying the magnetic roller to an image forming apparatus. In addition, in the present embodiment, by burying the rare-earth magnetic block 65' as illustrated in FIG. 14, strong magnetization can be partially achieved.

Figure 16A:
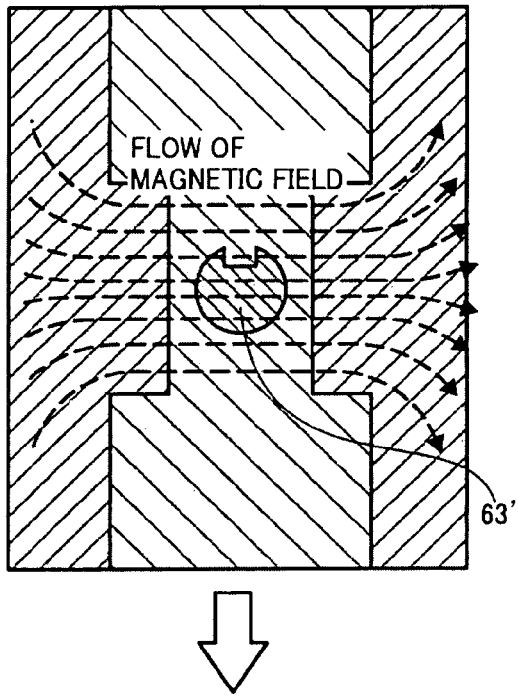
FIG. 16A is a view illustrating a manufacturing process of the magnetic roller according to the second embodiment of the present invention, describing a process for forming the magnetic roller by means of magnetic field forming.
Figure 16B:
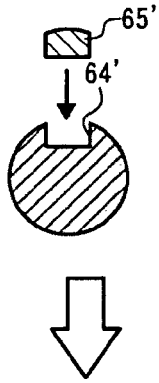
FIG. 16B is a view describing a process for disposing a rare-earth magnetic block to be fastened in the formed magnetic roller according to the second embodiment of the present invention.
Figure 16C:
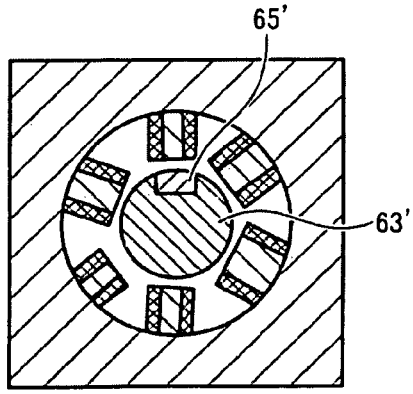
FIG. 16C is a view describing a process for magnetizing the magnetic roller provided with the rare-earth magnetic block according to the second embodiment of the present invention.

As a method of molding the magnetic roller 6', magnetic field extrusion molding or injection molding in a magnetic field is used. However, it is preferable to mold by means of the injection molding because the diameter of the body part 63' is different from the diameter of the shaft parts 62', 62'. As illustrated in FIGS. 16A-16C, when the magnetic roller 6' is molded by means of the injection molding, the rare-earth magnetic block 65' is fastened to the concave groove 64' by using an adhesive agent after molding (FIG. 16A) the magnetic roller while applying a magnetic field in one direction. Alternatively, the magnetic roller 6' is molded by introducing resin for a plastic magnet into a die in which the rare-earth magnetic block 65 is previously inserted as an inset. After that, the magnetic roller 6' is magnetized (FIG. 16C) and is also magnetized in multi-poles by using a magnetization yoke 8.

In the present embodiment, the material of the magnetic roller 6' is required to be a material which can be molded by the injection molding. For example, a plastic magnet or rubber magnet can be used.

For the plastic magnet or the rubber magnet, a material having flexibility such that magnetic powder providing magnetization is added to heat-hardening resin, thermoplastic resin, or unvulcanized rubber (vulcanized agent composition) can be used.

As the specific material of a plastic magnet or a rubber magnet, a high-polymer material of thermoplastic resin such as a PA (polyamide) series material, for example, 6 PA (nylon 6) or 12 PA (nylon 12), ethylene series compound, for example, EEA (ethylene•ethylacrylate copolymer), EVA (ethylene•vinyl acetate copolymer), a chlorine material, for example, CPE (chlorinated polyethylene), and a rubber material, for example, NBR (nitrile•butadien rubber), and a high-polymer compound of heat-hardening resin such as an epoxy series, silicone series, and urethane series are used. However, it is preferable to use a polyamide series thermoplastic resin because it has high rigidity and can be easily molded by means of the injection molding.

As the magnetic powder, a rare-earth magnet such as ferrite, or Ne series (for example, Ne—Fe—B) or Sm series (for example, Sm—Co, Sm—Fe—N) for obtaining a higher magnetic property is used.

The body part 63' and the shaft parts 62', 62 are integrally molded by using the above material. In this case, the entire magnetic roller can be formed by the same member. However, if an especially high magnetism is partially required, the rare-earth magnetic block 65' including rare-earth magnet powder and resin can be applied to the body part 63' including ferrite powder and resin. In this case, an expensive rare-earth magnetic block 65' is partially required, so the costs can be reduced compared with a case where the expensive rare-earth magnetic block 65' is applied in whole.

As described above, when high magnetism is partially required, if the rare-earth magnetic block 65' is disposed in the body part 63' including ferrite powder and resin, the long rare-earth magnetic block 65' having the same length as the length in the axial direction of the body part 63', or having a length slightly shorter than the length in the axial direction of the body part 63' is formed, and then, the rare-earth magnetic block 65' is buried in the outer circumference face of the body part 63' such that the length direction of the rare-earth magnetic block 65' coincides with the axial direction of the magnetic roller 6'. Therefore, the magnetism in the axial direction of the magnetic roller 6' is uniformed, and a high magnetic force can be partially obtained.

As a type of rare-earth magnet, it is common to use Nd—Fe—B and Sm—Fe—N as the magnetic powder. As a method of molding the rare-earth magnetic block 65', a method of conducting injection molding by mixing rare-earth magnetic powder with 6 PA (nylon 6) and a method of conducting compression molding by mixing rare-earth magnetic powder with resin powder such as polyether can be used. In this case, high magnetic proprieties can be obtained by performing the compression molding or the injection molding in the magnetic field.

When molding the magnetic roller 6' of the present embodiment in the magnetic field, if the shaft parts 62', 62' are covered with a high-permeability material, the magnetism moves to the high-permeability material, and the magnetism does not affect the shaft parts 62', 62'. Therefore, the magnetic roller 6' can be molded without magnetizing the shaft parts 62', 62'. As a high-permeability material having a high magnetism shielding effect, permalloy, silicon sheet, amorphous, and iron can be used, but it is preferable to use iron in terms of the workability and the costs.

When molding the magnetic roller 6' in the magnetic field, it is possible to magnetize the magnetic roller 6' to have desired magnetic properties while conducting the injection molding. However, there may be a case in which the die structure becomes complex and the magnetic flux density in the longitudinal direction of the magnetic roller 6' easily differs. Therefore, as illustrated in FIG. 7, the magnetic roller 6' is molded in the magnetic field oriented in one direction by using a simplified die structure when conducting the injection molding such that the magnetic body of the magnetic roller 6' is oriented in one direction. It is preferable to once demagnetize (demagnetization process) the magnetic roller 6' after removing the magnetic roller 6' from the die, and then to re-magnetize (re-magnetization process) the magnetic roller to have the desired magnetic properties. By using this method, even if the desired magnetic properties change to some degree while molding the magnetic roller 6', it is possible to easily correspond to the change, and also it is advantageous in terms of the workability, the costs, and the shortening of the development period. The molding method of the magnetic roller 6' using the die 7 is the same as that in the above-described embodiment; thus, a detailed explanation will be omitted.

In the case of molding the magnetic roller 6', even if the above-described method of preventing the magnetization is not applied to the shaft parts 62', 62', and as a result, the shaft parts 62', 62' are magnetized when removing the magnetic roller 6' from the die, the re-magnetization of the shaft parts 62', 62' can be prevented by shielding the magnetism of the periphery of the shaft parts 62', 62' by means of the high-permeability material in the re-magnetization (re-magnetization process) after demagnetizing the magnetic roller 6'. Therefore, the magnetic roller 6 of which the shaft parts 62', 62' are not magnetized can be obtained.

Alternatively, the magnetic roller 6' according to the present embodiment can be obtained if only the shaft parts 62', 627 are disposed in air core coils at the end, and the demagnetization process using the air core coils is conducted without conducting the magnetism shielding with respect to the shaft parts 62', 62' in the case of the molding and re-magnetization process.

The magnetic roller 6' according to the present embodiment can be used as the magnetic roller of the developer carrier 4 according to the first embodiment, so that the developer carrier 4' according to the present embodiment can be obtained.

Figure 17:
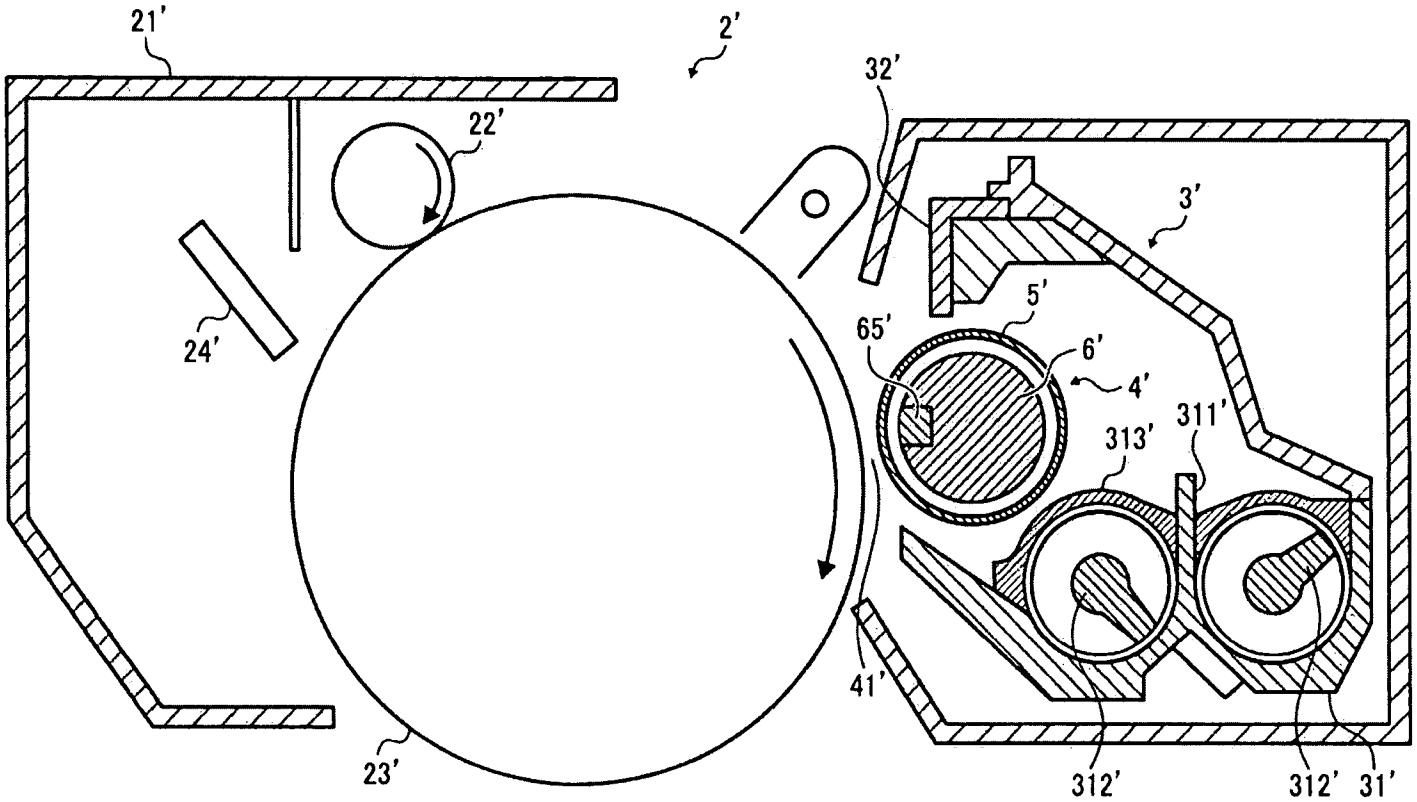
FIG. 17 is a schematic view illustrating a development device including the developer carrier according to the second embodiment of the present invention, and a processing cartridge including the development device.

Moreover, as illustrated in FIG. 17, by incorporating the developer carrier 4' having the magnetic roller 6' according to the present embodiment into the processing cartridge 2 of the first embodiment illustrated in FIG. 9, the processing cartridge 2' of the present embodiment can be obtained.

In this case as illustrated in FIG. 17, the processing cartridge 2' includes a development device 3' including the developer carrier 4' having inside thereof the magnetic roller 6' according to the present embodiment, a developer supply member 31', and a developer control member 32', a photoreceptor drum 23', and a charging roller 22'. The processing cartridge 2' includes the development device according to one embodiment of the present invention as the development device 3'.

As described above, if the processing cartridge 2' including the development device 3' having the developer carrier 4', the developer supply member 31' and the developer control member 32', the photoreceptor drum 23', and the charging roller 22' includes the development device according to one embodiment of the present invention as the development device 3', the processing cartridge 2' capable of obtaining an image free from irregularities can be provided at low cost.

Embodiment 2-1

A magnetic roller was molded by means of injection molding which injects a plastic magnet resin composition including an anisotropic ferrite magnet and nylon series resin (nylon 6) into a cavity of a die to which an electric field was applied. The magnetic roller includes a body part including a columnar form of 8.5 mm in diameter and 140 mm in length and shaft parts, each of 5 mm in diameter and 10 mm in length, coaxially-disposed on the both ends of the columnar form.

The die for molding the above-described magnetic roller includes shaft part forming portions on the both ends each made of a magnetic body (HPM1 manufactured by Hitachi Metals Tool Steel, Ltd.) and a body part forming portion made of a non-magnetic body (stainless steel SUS304). The magnetic field is only applied to the body part forming portion of the cavity.

After molding the magnetic roller, the magnetic flux density of the obtained magnetic roller was measured by a gaussmeter (HGM-8900 manufactured by ADS Corporation). In this case, the magnetic flux density in the magnetic pole position surface of the shaft part (the position that the magnetic flux density is the highest) was 0.1 mT. Accordingly, it was confirmed that the shaft parts were prevented from being magnetized.

Moreover, a concave groove into which a rare-earth magnetic block of 3.5 mm in width in the axial direction (longitudinal direction) and 2.2 mm in depth is buried is provided in the circumference face of the magnetic roller.

Comparative Example 2-1

A magnetic roller having the same shape as that in the embodiment 2-1 was molded similar to the embodiment 1 by using a die having an entirely non-magnetic body (stainless SUS 304).

The magnetic flux density of the obtained magnetic roller was measured. In this case, the magnetic flux density in the magnetic pole position surface of the shaft part was 30 mT. Accordingly, it was confirmed that the shaft parts are magnetized.

Embodiment 2-2

After molding a magnetic roller similar to the comparative example 2-2, the entire magnetic roller was once demagnetized by using a magnetizing and demagnetizing device manufactured by Nihon Denji Sokuteiki, Co., Ltd.

Next, a rare-earth magnetic block in a bar separately formed by rare-earth magnetic powder and nylon 12 was buried in the concave groove of the body part into which the rare-earth magnetic block was buried, and the rare-earth magnetic block was fastened to the concave groove by adhesive agent.

Figure 18:
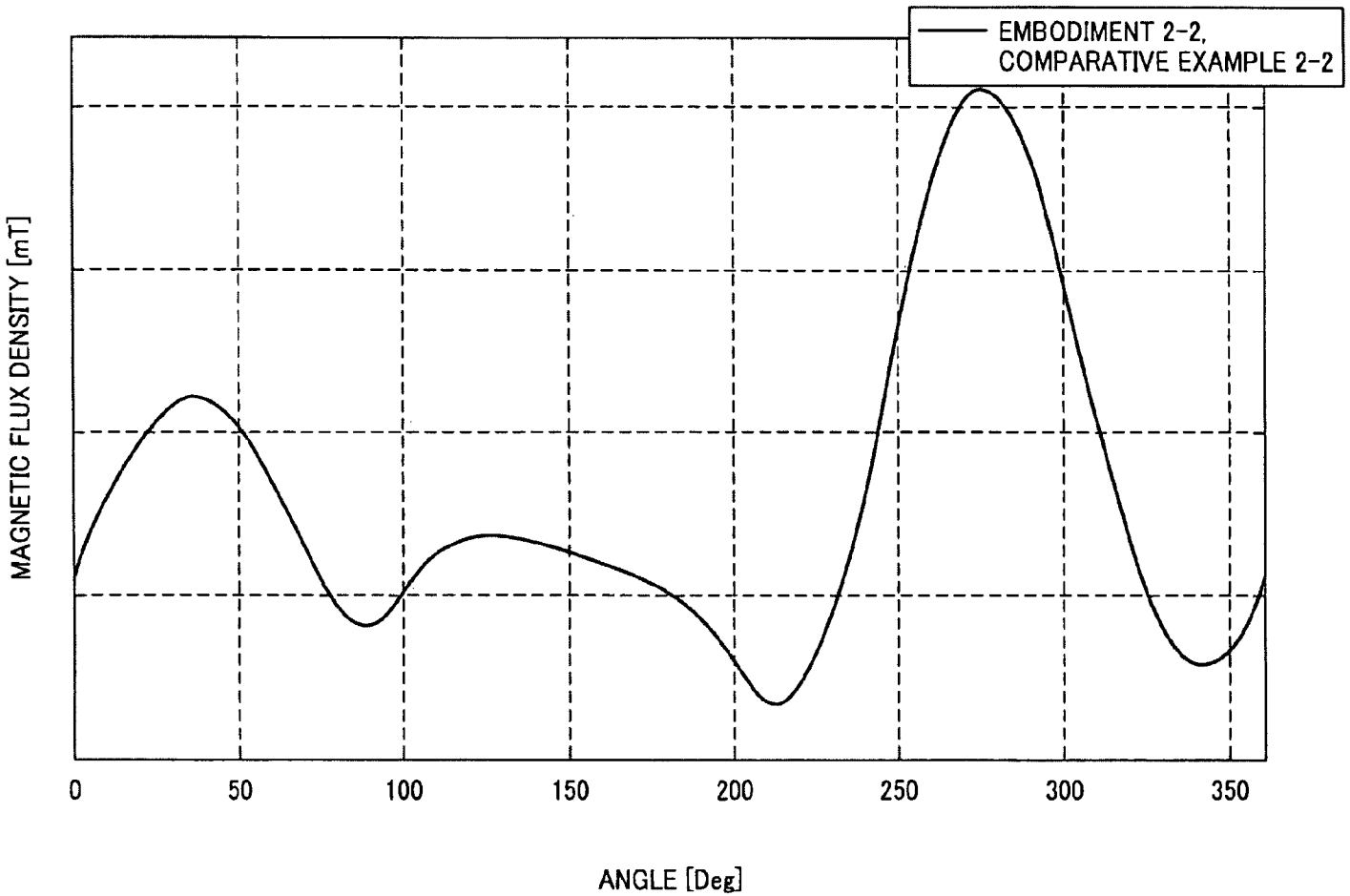
FIG. 18 is a view illustrating magnetic properties of the circumferential directions of the magnetic rollers in an embodiment 2-2 and a comparative example 2-2.

After that, the magnetic roller was re-magnetized by a yoke magnetizing method, and the magnetic roller having the magnetic properties illustrated in FIG. 18 was obtained. In FIG. 18, the horizontal axis indicates an angle from a given part and the vertical axis indicates magnetic flux density.

The rare-earth magnetic block buried in the body part was formed by molding a material mixed anisotropic Ne—Fe—B (powder) with powdered nylon 12 (12 PA) by means of compression molding. The rare-earth magnetic block has 3 mm in width, 2.2 mm in height, and 140 mm in length.

When conducting the yoke magnetizing method, iron caps were disposed in the shaft parts on the both ends of the magnetic roller, so as to prevent the magnetization of the shaft parts and to only magnetize the body part. In this case, the magnetic flux density in the magnetic pole position surface of the shaft part after the magnetization process was 0.1 mT or less. Accordingly, it was confirmed that the shaft parts were prevented from being magnetized.

Comparative Example 2-2

A magnetic roller similar to the magnetic roller in the comparative example 2-1 was molded by means of injection molding in a magnetic field. After this magnetic roller was once demagnetized, the rare earth magnetic block the same as that used in the embodiment 2-2 was buried in the concave groove of the body part into which the rare-earth magnetic block was buried, and the rare-earth magnetic block was fastened with an adhesive agent. After that, the magnetic roller was re-magnetized by the yoke magnetizing method, and the magnetic roller having the magnetic properties illustrated in FIG. 18 was obtained.

The magnetic flux density in the magnetic pole position surface of the shaft parts after the magnetization process of the magnetic roller was 35 mT. Accordingly, it was confirmed that the shaft parts were magnetized.

In the magnetic pole position in which the magnetic flux density of the magnetic roller of each of the embodiment 2-2 and the comparative example 2-2 is the highest, the magnetic flux density distribution in the longitudinal direction of the body part of the magnetic roller in a position away from the body part at 0.85 mm was measured by the gaussmeter. The measurement results are illustrated in FIG. 19.

When using the magnetic roller as the developer carrier, the magnetic pole having the highest magnetic flux density is generally used as the development pole. In the developer carrier, the development sleeve of the non-magnetic cylinder body having an outer diameter larger than the outer diameter of the magnetic roller at 1 mm to 1.5 mm is fitted to the magnetic roller from the outside thereof. If the magnetic flux density difference in the longitudinal direction of the development pole is 5 mT or more in the development sleeve surface, irregularities are generated on an image.

Figure 19:
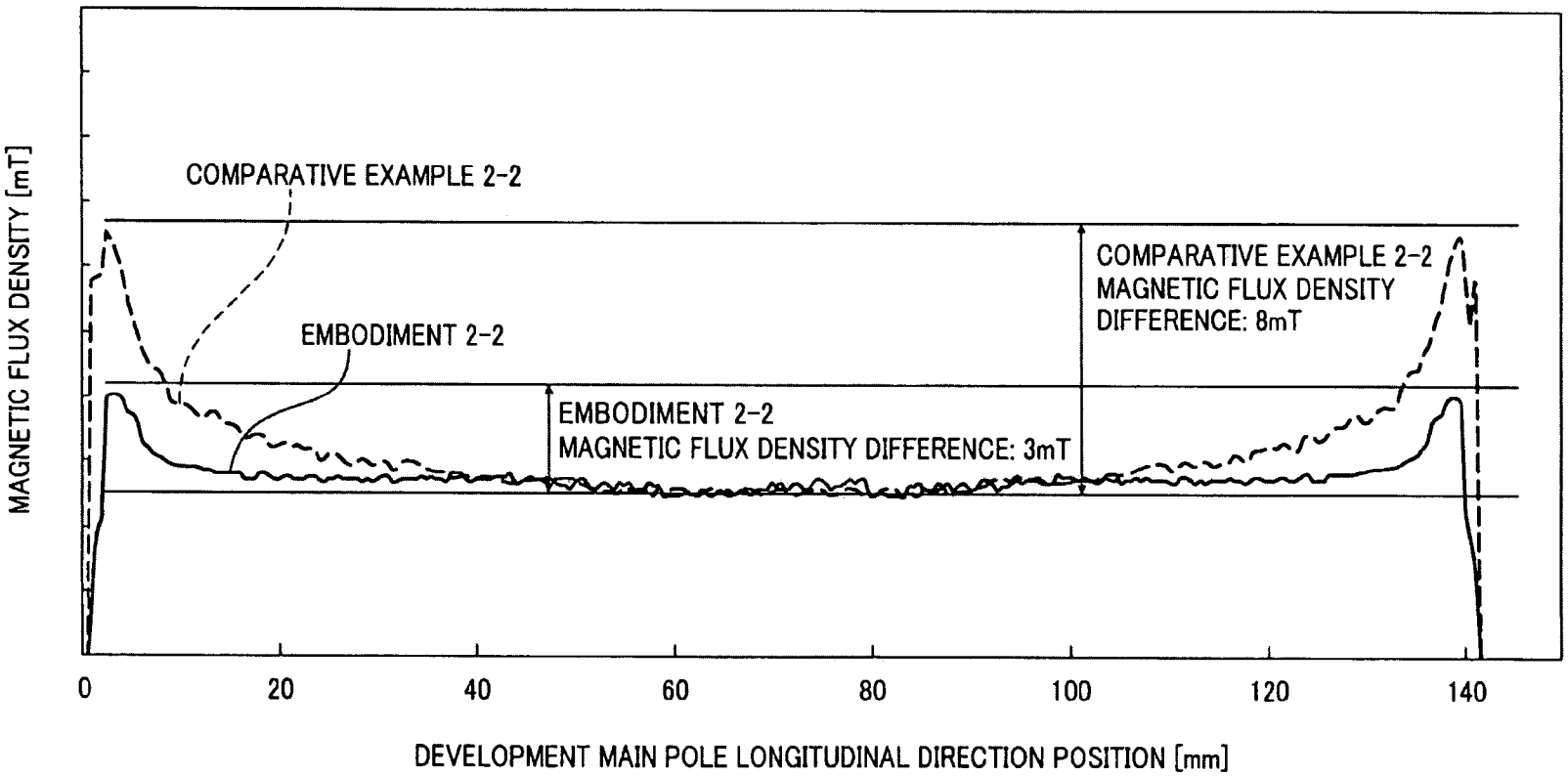
FIG. 19 is a view illustrating the magnetic flux density distribution of the axial directions of the body parts of the magnetic rollers in the embodiment 2-2 and the comparative example 2-2.
Figure 20:
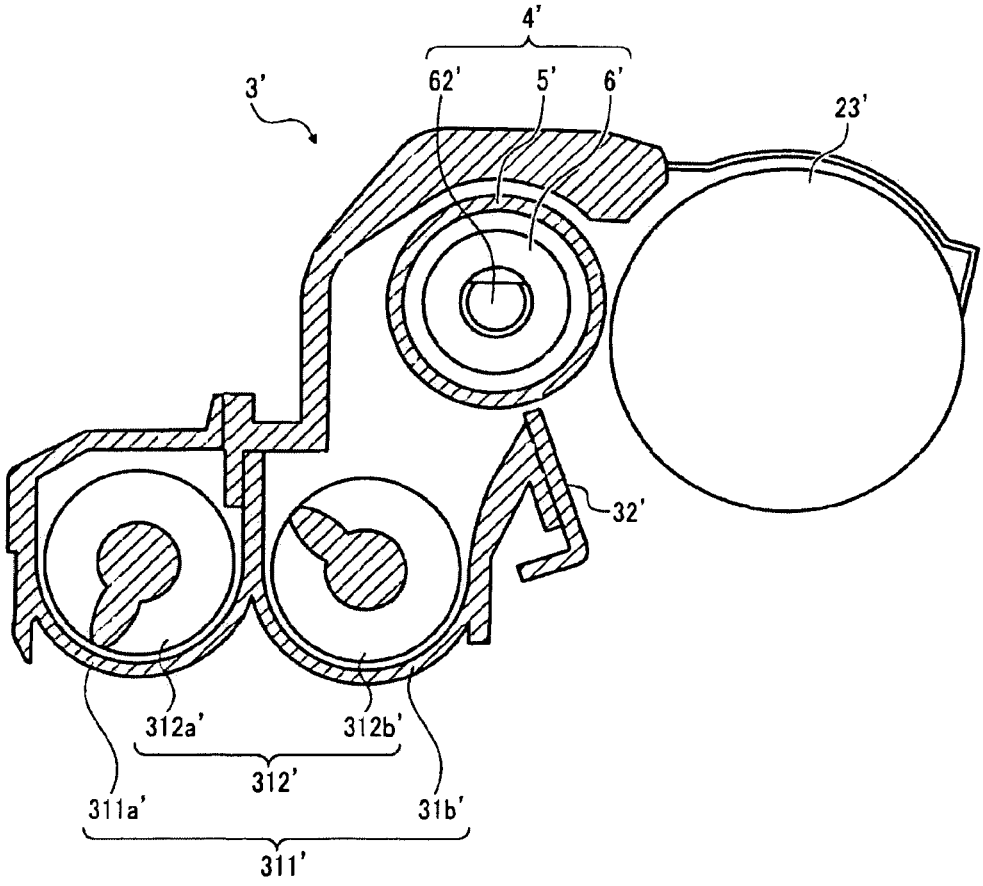
FIG. 20 RELATED ART
FIG. 20 is a sectional view illustrating a related art development device.

According to the measurement results illustrated in FIG. 19, the magnetic roller of the comparative example 2-2 in which the shaft parts are magnetized has a position such that the magnetic flux density difference in the longitudinal direction of the development pole becomes 5 mT or more. For this reason, if this magnetic roller is used as the developer carrier, irregularities are generated on an image. On the other hand, the magnetic roller of the embodiment 2-2 in which the shaft parts are not magnetized does not have a position in which the magnetic flux density difference in the longitudinal direction of the development pole becomes 5 mT or more. For this reason, if this magnetic roller is used as the developer carrier, a high quality image free from irregularities can be obtained. In the actual image formation tests in the image forming apparatus in which these magnetic rollers are actually incorporated, the image forming apparatus incorporated with the magnetic roller of the embodiment 2-2 obtains the image free from irregularities better than the image obtained by the image forming apparatus incorporated with the magnetic roller of the comparative example 2-2.

According to the magnetic roller of one embodiment of the present invention, even if the magnetic roller has a reduced diameter, the volume of the part operating as a magnet can be increased. Therefore, the magnetic roller having a strong magnetic force can be obtained.

According to the magnetic roller of one embodiment of the present invention, if this magnetic roller is used as the development device, the magnetic roller having a long operating life (useful life) in which the developer is not attracted to the shaft parts can be provided. In addition, since the magnetic flux density difference in the longitudinal direction of the magnetic roller is small, a high quality image without having irregularities can be formed even if the magnetic roller is small.

According to the magnetic roller of one embodiment of the present invention, if this magnetic roller is used as the development device, when the developer fed to the development area separates from the photoreceptor drum, the developer receives a high magnetic force from which the magnetic roller on the reverse-rotation direction side of the magnetic roller adjacent to the magnetic block, so that the magnetic carriers of the developer can be prevented from being transferred onto the photoreceptor drum. Therefore, unnecessary magnetic carriers can be prevented from being transferred onto the photoreceptor drum, and thus, a high quality image can be obtained.

According to the magnetic roller of one embodiment of the present invention, even if the magnetic roller has a reduced diameter, it can generate a sufficiently high magnetic force.

According to the developer carrier of one embodiment of the present invention, even if the magnetic roller has a reduced diameter, the volume of a portion operating as a magnet can be increased. For this reason, the magnetic roller having a strong magnetic force can be obtained.

According to the developer carrier of one embodiment of the present invention, the magnetic roller having a long operating life in which the developer is not attracted to the shaft parts can be provided. In addition, since the magnetic flux density difference in the longitudinal direction of the magnetic roller is small, a high quality image free from irregularities can be provided even if the magnetic roller is small.

According to the developer carrier of one embodiment of the present invention, when the developer fed to the development area separates from the photoreceptor drum, the developer receives the high magnetic force of the magnetic roller on the reverse-rotation direction side of the magnetic roller adjacent to the magnetic block. Therefore, the magnetic carriers of the developer are prevented from being transferred onto the photoreceptor drum. For this reason, unnecessary magnetic carriers can be prevented from being transferred onto the photoreceptor drum, and a high quality image can be obtained.

According to the developer carrier of one embodiment of the present invention, when providing the concaves on the surface of the development sleeve, the development sleeve does not curve. Accordingly, the highly accurate development sleeve can be obtained. In addition, by the highly accurate development sleeve provided with the concaves on the surface, the feeding amount of the developer can be uniformed. Therefore, a high quality image without having an uneven concentration can be obtained.

According to the method of manufacturing the magnetic roller of one embodiment of the present invention, the magnetic roller having a reduced diameter and a high magnetic force can be manufactured by the simple structured die. Therefore, the manufacturing cost of the die can be controlled.

According to the method of manufacturing the magnetic roller of one embodiment of the present invention, the magnetic roller having a long operating life in the developer is not attracted to the shaft parts can be manufactured.

According to the development device of one embodiment of the present invention, the development device can be downsized. In addition, the development device capable of forming a high quality image can be provided.

According to the development device of one embodiment of the present invention, the magnetic carrier has good granularity, and a high quality image having less irregularities can be formed.

According to the processing cartridge of one embodiment of the present invention, the processing cartridge can be downsized. Moreover, the processing cartridge capable of forming a high quality image can be provided.

According to the image forming apparatus of one embodiment of the present invention, the image forming apparatus can be downsized. In addition, the image forming apparatus capable of forming a high quality image can be provided.

Although the present invention has been described in terms of exemplary embodiments, it is not limited thereto. It should be appreciated that variations may be made in the embodiments described by person skilled in the art without departing from the scope of the present invention as defined by the following claims.

What is claimed is:

1. A magnetic roller having a plurality of magnetic poles including a main magnetic pole, an adjacent magnetic pole adjacent to the main magnetic pole on a reverse-rotation direction side of the magnetic roller, and at least one other magnetic pole, wherein the main magnetic pole exhibits a magnetic force that is the highest magnetic force among all of the magnetic poles and wherein the adjacent magnetic pole exhibits a magnetic force that is higher than the magnetic force of the at least one other magnetic pole, comprising:

a solid-core roller, the entirety of the roller having magnetic anisotropy in the same direction orthogonal to a central axis thereof, the solid-core roller, including:

a body part; and shaft parts disposed on both ends of the body part; and a concave groove provided at a single circumferential location in an outer circumference face of the body part to extend in an axial direction; and a magnetic block disposed in the concave groove to provide the main magnetic pole, the magnetic block having a direction of magnetic anisotropy substantially orthogonal to the direction of the magnetic anisotropy of the solid-core roller, wherein the concave groove comprises the only groove in the outer circumference face of the body part having a magnetic block disposed therein.

2. The magnetic roller according to claim 1, wherein the shaft parts are not magnetized.

3. The magnetic roller according to claim 1, wherein the magnetic block is a rare-earth magnet.

4. A developer carrier, comprising:

a cylindrical development sleeve; and a magnetic roller having a plurality of magnetic poles including a main magnetic pole, an adjacent magnetic pole adjacent to the main magnetic pole on a reverse-rotation direction side of the magnetic roller, and at least one other magnetic pole, wherein the main magnetic pole exhibits a magnetic force that is the highest magnetic force among all of the magnetic poles and wherein the adjacent magnetic pole exhibits a magnetic force that is higher than the magnetic force of the at least one other magnetic pole, the magnetic roller having a body part and shaft parts provided on both ends of the body part, the magnetic roller being coaxially disposed inside the development sleeve, the magnetic roller, including:

a solid-core roller, the entirety of the roller having magnetic anisotropy in the same direction orthogonal to a central axis thereof;

a concave groove disposed at a single circumferential location in an outer circumference face of the magnetic roller to extend in an axial direction; and a magnetic block disposed in the concave groove to provide the main magnetic pole, the magnetic block having a direction of magnetic anisotropy substantially orthogonal to a direction of the magnetic anisotropy of the solid-core roller, wherein the concave groove comprises the only groove in the outer circumference face of the body part having a magnetic block disposed therein.

5. The developer carrier according to claim 4, wherein the shaft parts are not magnetized.

6. A development device comprising the developer carrier set forth in claim 5.

7. The development device according to claim 6, wherein the developer includes toner and magnetic carriers, and an average particle diameter of each of the magnetic carriers is 20 μm or more and 50 μM or less.

8. A processing cartridge comprising the development device set forth in claim 6.

9. An image forming apparatus comprising the processing cartridge set forth in claim 8.

10. The developer carrier according to claim 4, wherein the development sleeve has a plurality of recesses formed by randomly crushing linear materials disposed in a rotation magnetic field onto an outer circumference face of the development sleeve by using the rotation magnetic field.

11. A development device comprising the developer carrier set forth in claim 4.

12. The development device according to claim 11, wherein the developer includes toner and magnetic carriers, and an average particle diameter of each of the magnetic carriers is 20 μm or more and 50 μm or less.

13. A processing cartridge comprising the development device set forth in claim 11.

14. An image forming apparatus comprising the processing cartridge set forth in claim 13.

* * * * *